US007563213B2

(12) United States Patent
Grant

(10) Patent No.: US 7,563,213 B2
(45) Date of Patent: Jul. 21, 2009

(54) EXERCISE APPARATUS

(76) Inventor: Eugene Grant, 655 Spice Island Dr., Sparks, NV (US) 89431

( * ) Notice: Subject to any disclaimer, the term of this patent is extended or adjusted under 35 U.S.C. 154(b) by 396 days.

(21) Appl. No.: 11/503,341

(22) Filed: Aug. 10, 2006

(65) Prior Publication Data

US 2008/0039302 A1 Feb. 14, 2008

(51) Int. Cl.
*A63B 21/04* (2006.01)
*A63B 21/02* (2006.01)

(52) U.S. Cl. ..... 482/129; 482/122

(58) Field of Classification Search ..... 482/93, 482/97–101, 122, 129, 135, 130, 133, 136, 482/138

See application file for complete search history.

(56) References Cited

U.S. PATENT DOCUMENTS 2,921,791 A * 1/1960 Berne ..... 482/118
RE28,066 E 7/1974 Marcyan
3,905,599 A * 9/1975 Maxman ..... 482/98
3,912,263 A 10/1975 Yatso
4,072,309 A 2/1978 Wilson
4,339,125 A 7/1982 Uyeda et al.
4,603,855 A * 8/1986 Sebelle ..... 482/103
4,898,381 A * 2/1990 Gordon ..... 482/103
5,039,092 A 8/1991 Olschansky et al.
5,522,784 A 6/1996 Grant
6,238,323 B1 * 5/2001 Simonson ..... 482/103
6,488,612 B2 * 12/2002 Sechrest et al. ..... 482/103

* cited by examiner

*Primary Examiner*—Loan H Thanh
*Assistant Examiner*—Allana Lewin

(57) ABSTRACT

A non-gravity-type resistance exercise apparatus that includes a novel pulley-carrying exercise arm that can be incrementally rotated in a novel manner between high, low and numerous intermediate exercise positions to enable the proper performance of a number of different exercises. The apparatus includes a compact, self-contained, selectorized resistance module that embodies a plurality of discrete, elongated elastomeric cords that can be quickly and easily selectively coupled with the body-engaging means to provide precise resistance to the performance of several different kinds of exercises.

22 Claims, 20 Drawing Sheets

EXERCISE APPARATUS

BACKGROUND OF THE INVENTION

1. Field of the Invention

The present invention relates generally to a body exercising apparatus and, more particularly, to a compact, multi-purpose exercise machine for accomplishing a number of progressive resistance-type exercises using a resistance unit, which provides a variable resistance to the performance of the exercises.

2. Discussion of the Prior Art

The therapeutic value of progressive resistance exercises has long been recognized. Exercising muscles against progressively increasing resistance not only results in added strength and endurance in the muscles, but also in the improvement of neuromuscular coordination and in a more efficient functioning of the cardiovascular and respiratory systems.

In the past, various types of progressive weight training machines have been suggested. Among these prior art devices are those described in U.S. Pat. No. 4,339,125 issued to Uyeda, et al., U.S. Pat. No. Re. 28,006 issued to Marcy, and in U.S. Pat. No. 3,912,263 issued to Yatso.

Typically the prior art exercise apparatus uses one or more weights selected from a stack of weights to provide gravity resistance to the movement of a carriage or other body-engaging means. Such apparatus is typically quite bulky and difficult to use in confined areas having limited ceiling heights. Further, the prior art devices are generally difficult to transport and store.

In an attempt to make exercise apparatus lighter and less bulky, easier to use and more versatile, several exercise devices have been suggested which use elastomeric members rather than weights to provide non-gravity resistance to the performance of the exercises. One of the earliest of such devices is described in U.S. Pat. No. 4,072,309 issued to Wilson. The latter device uses circular spring cords, such as aircraft shock cords, to resist movement of a lever arm, which is pivotally connected to an upright structural member. Another such device is disclosed in Olschansky, et al., U.S. Pat. No. 5,039,092 issued Aug. 13, 1991. This patent concerns a multi-exercise system that includes a rotational-actuation mechanism, which is adapted for bi-directional rotation about a singular axis and is coupled to an upper carriage comprising a resistive force mechanism. The rotational-actuation mechanism provides an initial rotative displacement in either of two opposite directions, which is transformed into a linear displacement of the resistive force-loading members. The rotational-actuation mechanism includes a sprocket wheel whose rotative axis is displaced from the sprocket wheel center for compensating for the change in load force as the elastic cord resistance members of the device are stretched.

Following commercialization of the Wilson and Olschansky devices, several other types of exercising devices have been suggested which use elastomeric resistance imparting elements, including solid rubber resistance-type units. The prior art elastomeric cord or solid rubber resistance-type units are, of course, much lighter than the solid weight type units, but are still quite bulky and difficult to use and store in areas having limited ceiling height. Another drawback of many of the elastomeric resistance-type exercise apparatus is that, in most cases, the resistance elements must be placed on each side of the lifting mechanism to maintain a balanced resistance. Further the prior art resistance elements tend to crack and fatigue making them susceptible to catastrophic failure.

Additionally, varying the resistance in many of the prior art elastomeric resistance-type units involves adding or subtracting individual elastomeric elements to the apparatus. This can be both cumbersome and time consuming. Further, since the elastomeric resistance elements are typically separate units, they can be lost or misplaced and frequently are strewn about the apparatus in a manner to create substantial tripping hazards.

One of the most successful of the prior art devices that use elastomeric resistance-imparting elements is the device disclosed in U.S. Pat. No. 5,552,784 issued to the present inventor. This unique device includes a highly novel, non-gravity, self-contained selectorized resistance module that is made up of a number of elastomeric cords which are assembled together into a compact resistance module which offers variable resistance from a single connection point on the module thereby always providing balanced resistance. A novel selector means permits a selected number of the elastomeric cords of the resistance module to be quickly and easily interconnected with the body-engaging means of the apparatus to provide precisely variable resistance to the performance of the given exercise. The present invention is an improvement of this earlier apparatus.

The device also includes a novel, non-gravity, self-contained selectorized resistance module that is made up of a number of elastomeric cords which are assembled together into a compact resistance module which offers variable resistance from a single connection point on the module thereby always providing balanced resistance. A novel selector means permits a selected number of the elastomeric cords of the resistance module to be quickly and easily interconnected with the body-engaging means of the apparatus to provide precisely variable resistance to the performance of the given exercise. As will be appreciated from the discussion that follows, the present invention is an improvement of this earlier apparatus.

The apparatus of the present invention overcomes many of the drawbacks of the prior art exercise devices by providing an apparatus that includes a compact basic supporting frame to which a novel pulley-carrying exercise arm is rotatably connected. The exercise arm incrementally rotates between a high latissimus exercise position, various intermediate positions and a low exercise position. This unique feature permits the proper performance of a number of different upper body, arm and leg exercises. The apparatus of the invention can be used with various types of resistant modules including free weights, selectorized weights and elastomeric cord-type resistance modules.

In one form of the apparatus of the present invention the resistance module comprises a novel, non-gravity, self-contained selectorized resistance module that is somewhat similar to, but a substantial improvement over, that disclosed in the inventor's earlier patent. This novel module is made up of a number of longer elastomeric cords that are assembled together into a compact resistance module. A unique selector means permits a selected number of the elastomeric cords of the resistance module to be quickly and easily interconnected with the body-engaging means of the apparatus to provide precisely variable resistance to the performance of the given exercise.

SUMMARY OF THE INVENTION

It is an object of the present invention to provide an improved, non-gravity type resistance exercise apparatus that is small, lightweight, highly versatile and easy-to-use. More particularly, it is an object of the invention to provide an exercising machine that includes a novel pulley-carrying exercise arm that can be incrementally rotated in a novel manner between high, low and numerous intermediate exercise positions to enable the proper performance of a number of different exercises.

Another object of the invention is to provide an apparatus of the aforementioned character in which the novel pulley-carrying exercise arm permits a full range of motion and can be used with a variety of different resistance modules, including free weight modules, selectorized weight modules and elastomeric cord-type resistance modules.

Another object of the invention is to provide an apparatus of the character described that includes a compact, self-contained, selectorized resistance module that embodies a plurality of discrete, elongated elastomeric cords that can be quickly and easily selectively coupled with the body-engaging means to provide precise resistance to the performance of several different kinds of exercises.

Another object of the invention is to provide an apparatus of the type described that includes a compact, self-contained, selectorized resistance module that uniquely allows for high or low speed movements with a smooth resistance.

Another object of the invention is to provide an apparatus of the class described which includes a supporting frame of limited height to which the pulley carrying exercise arm is rotatably connected. The pulley arm is readily movable by the trainee from a raised overhead, latissimus exercise position into a number of intermediate positions and then into a lowered position and can be conveniently locked in a selected position. A body-engaging means, such as a handlebar, is connected to one end of a cable that is entrained about the pulley of the pulley arm. The opposite end of the cable is interconnected with the resistance module to provide precisely variable resistance to movement of the body-engaging means during the performance of a particular exercise.

Another object of the invention is to provide an apparatus of the character described in the preceding paragraphs that includes a unique mechanism for selectively interconnecting the body-engaging means with the selected resistance imparting cords of the resistance module.

Another object of the invention is to provide an apparatus which provides readily variable resistance levels similar or equal to those found on home and commercial exercise devices.

Another object of the invention is to provide an apparatus of the character described in the preceding paragraphs that includes a compact, self-contained, selectorized resistance module that embodies a plurality of discrete, elastomeric cords that can be used with a conventional, non-rotating pulley-carrying exercise arm.

Another object of the invention is to provide a device that has numerous starting points of resistance to provide optimum positioning with free and natural range of motion.

Still another object of the invention is to provide a compact, lightweight exercise machine that is both safe and reliable, while at the same time providing a full range of movement when performing exercises.

Another object of the invention is to provide a device as described in the preceding paragraphs that is of simple design, embodies a minimum number of component parts and is easy to operate with a minimum of training.

Another object of the invention is to provide an exercise device of the character described that can be inexpensively manufactured, easily set up and operated and conveniently stored in confined areas having limited ceiling height.

DESCRIPTION OF THE INVENTION

Figures 5A, 6:
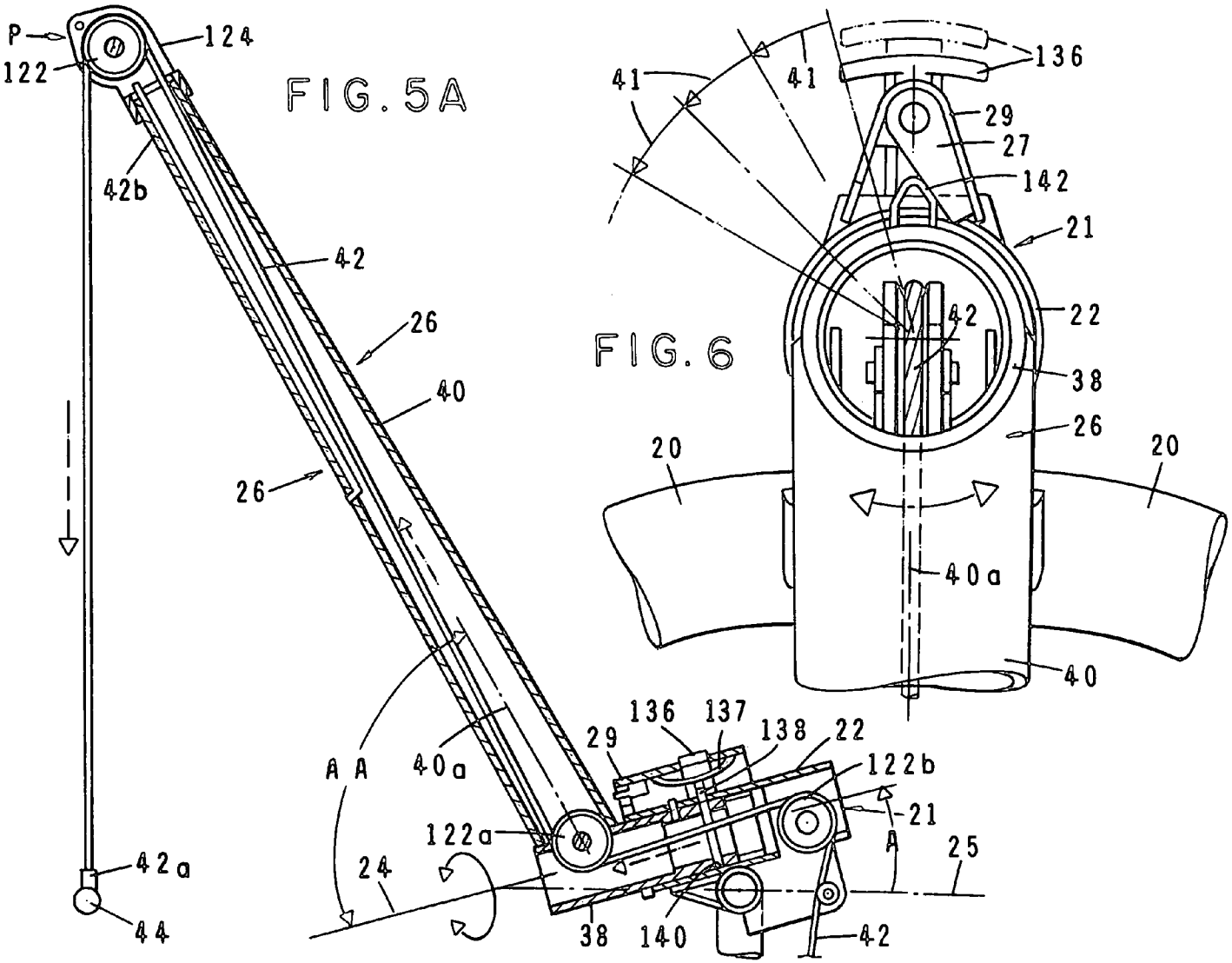
FIGS. 5A and 5B, when considered together, comprise a cross-sectional view taken along lines 5-5 of FIG. 3.
FIG. 6 is an enlarged, fragmentary front view of the upper portion of the apparatus.

Referring to the drawings and particularly to FIGS. 1-4, one form of the exercise apparatus of the present invention for use by a trainee in the performance of exercises is there illustrated and generally designated by the numeral 14. The apparatus here comprises a supporting frame 16 having a base portion 16*a* for engagement with a generally planar support surface defining a first plane 18 and an upstanding portion 20. Connected to upstanding portion 20 is a sleeve assembly 21 that includes a tubular sleeve 22 having an axial centerline 24. As best seen in FIG. 5A, axial centerline 24 extends at an acute angle "A" of between about 12 and about 18 degrees with respect to a second plane 25 that is vertically spaced-apart from and generally parallel to first plane 18.

Figure 3:
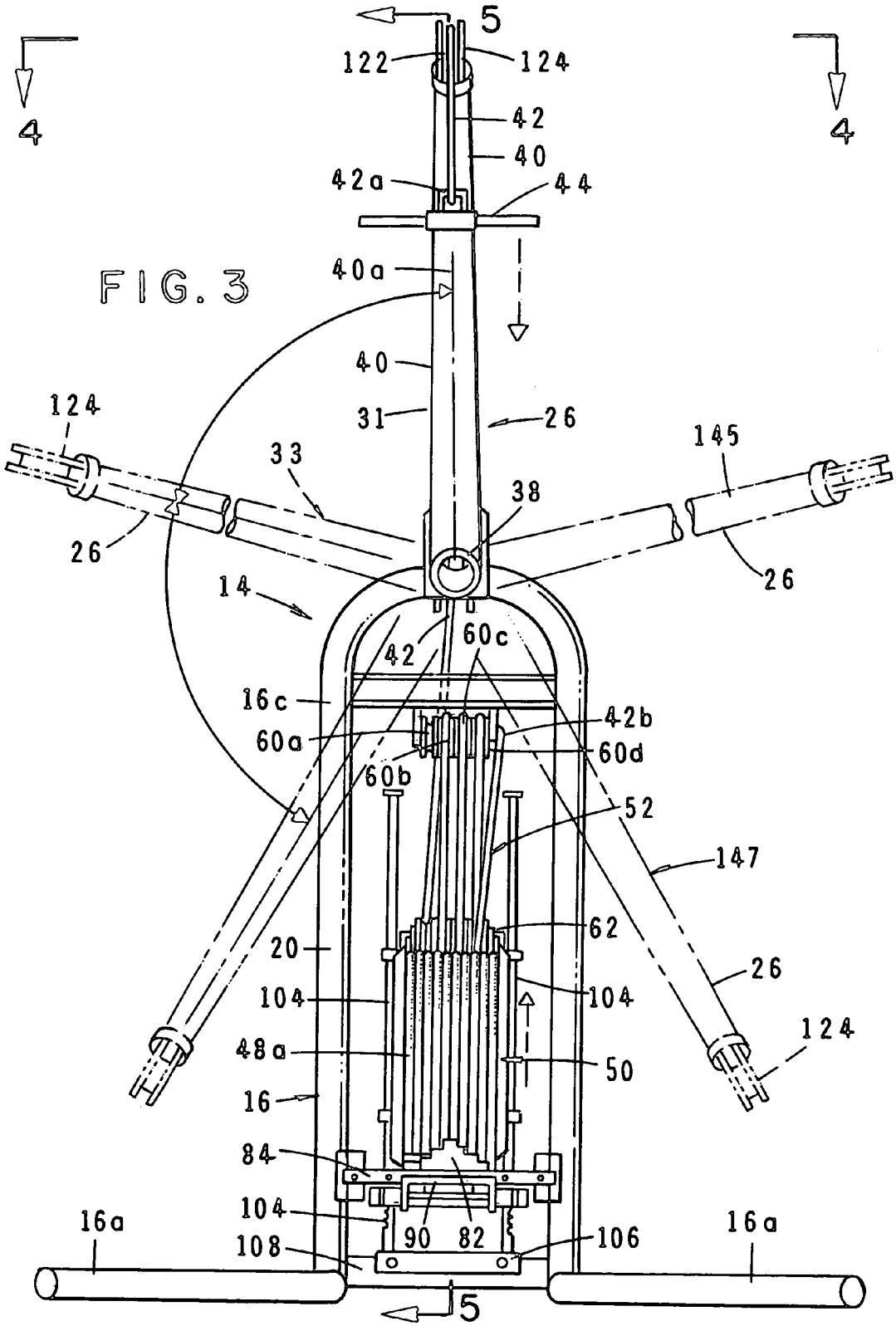
FIG. 3 is a front view similar to FIG. 2 but illustrating the incremental movement of the pulley arm of the apparatus between the upper and intermediate positions.

Rotatably connected to tubular sleeve 22 for rotation relative thereto is an arm assembly 26. As shown in FIG. 3, arm assembly 26 is controllably rotatable from a first upright position 31 to a first intermediate position 33 and to a second intermediate position 35. As will be discussed further in the paragraphs which follow, locking means, which are carried by sleeve 22, are operably associated with arm assembly 26 and function to securely lock the arm assembly in a selected position. A stop member 27, which forms a part of the locking means, is pivotally connected to an upstanding housing 29 that is connected to sleeve 22 and forms a part of the sleeve assembly 21 (see FIGS. 6 and 7).

Figure 1:
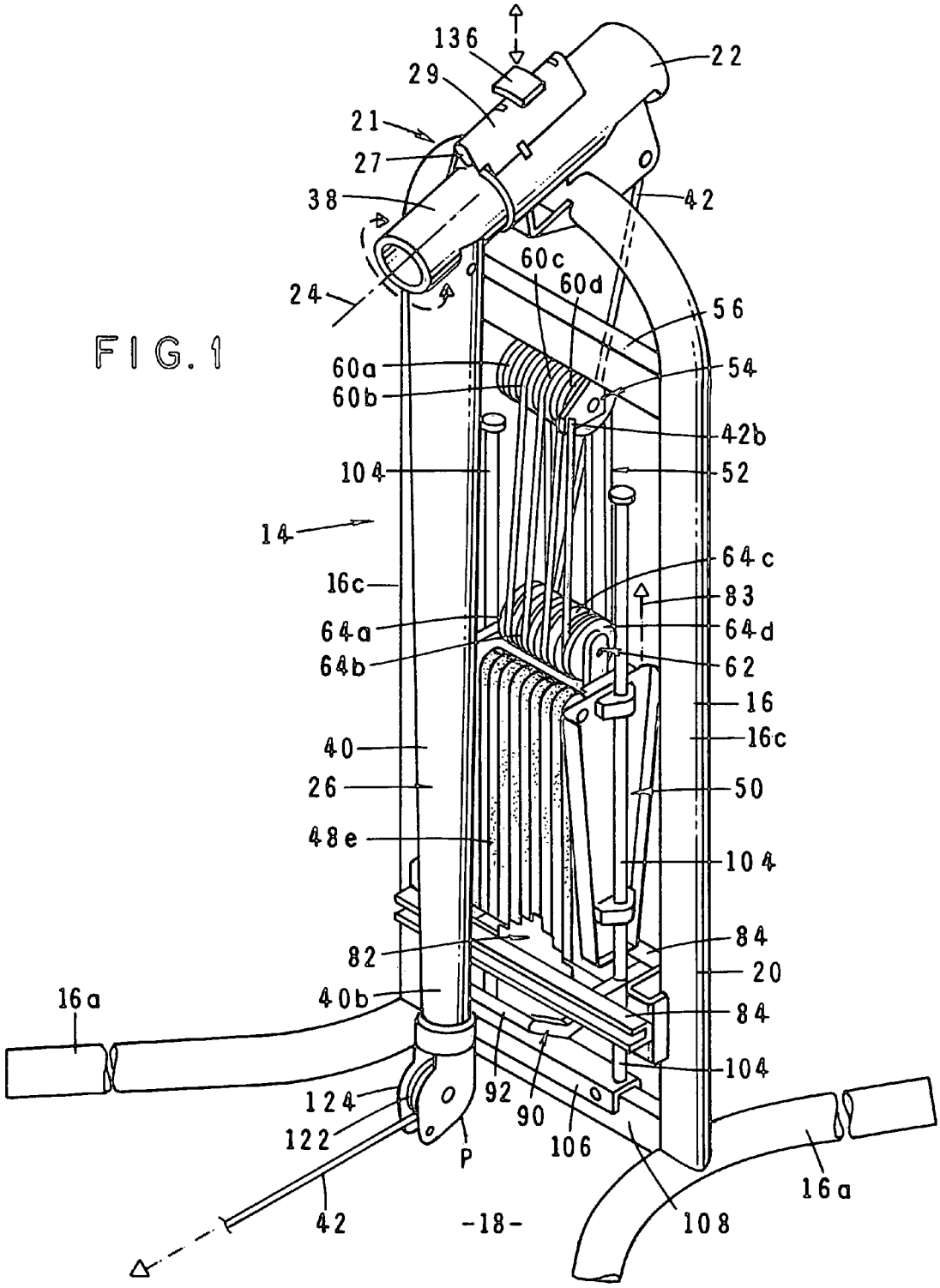
FIG. 1 is a generally perspective view of one form of the exercise apparatus of the invention.
Figure 2:
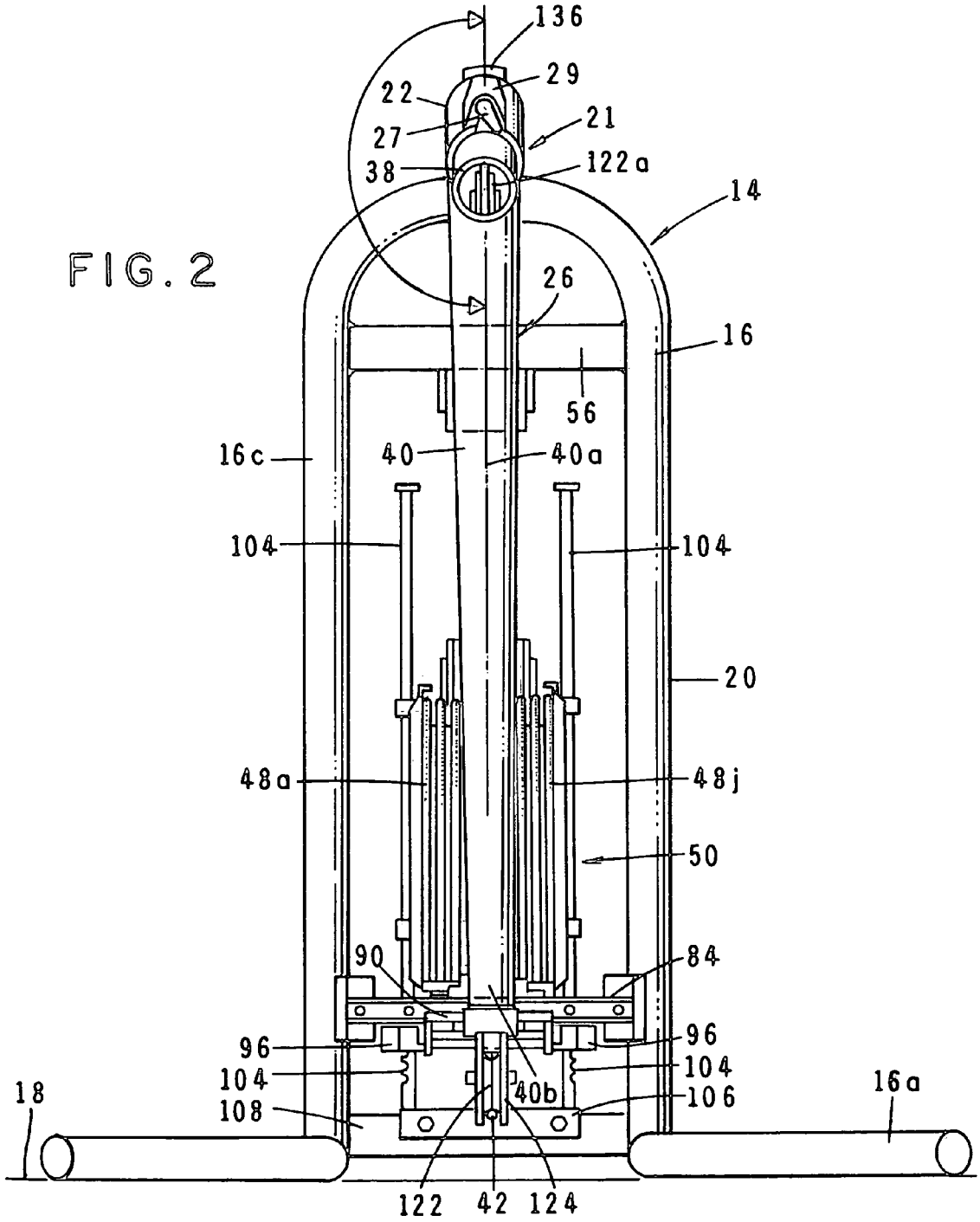
FIG. 2 is a front view of the apparatus.

As illustrated in FIGS. 1 and 5A, arm assembly 26 includes a generally cylindrically shaped hub portion 38, a portion that is telescopically received within tubular sleeve 22. Arm assembly 26 also includes a tubular arm portion 40, which has an axial centerline 40*a*. As indicated in FIG. 5A, arm portion 40 is connected to and extends from hub portion 38 in a manner such that the acute angle "AA" formed between center-lines 24 and 40*a* is between about 60 and about 80 degrees.

Figure 4:
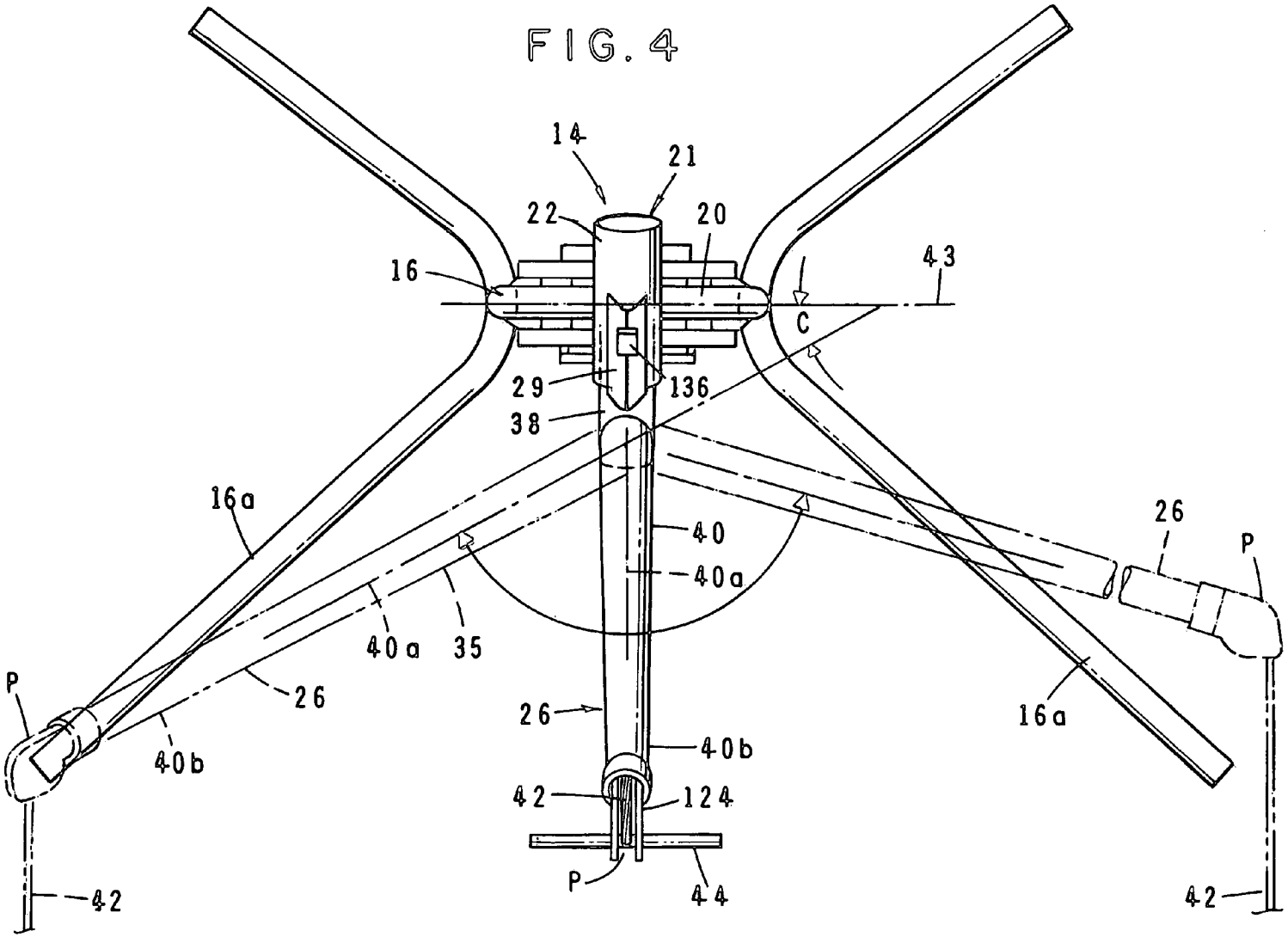
FIG. 4 is a view taken along lines 4-4 of FIG. 3.

As best seen in FIG. 4, the upstanding portion 20 of the support frame is disposed within a third plane 43 that is generally perpendicular to first plane 18. A novel feature of the present invention resides in the fact that, as shown in FIG. 4, upon rotation of the arm assembly 26 into the second intermediate position 35, the central axis 40*a* of the tubular arm portion 40 extends at an acute angle "C" relative to the third plane 43 of between about 20 and about 40 degrees. In this position the outboard end 40*b* of tubular arm portion 40, which includes the pulley "P" about which the elongated connector cable 42 is entrained, will be disposed outside the footprint of the base portion 16*a* so that the base portion will not interfere with exercises performed by the trainee when the arm assembly 26 is in the second intermediate position.

Connector cable 42, which is carried by arm assembly 22 for telescopic movement there within, has first and second ends 42*a* (FIG. 5A) and 42*b* (FIG. 1). Connected to first end 42*a* of the elongated connector cable is gripping, or body-engaging means for gripping by the trainee. This gripping means can take various forms, but is shown in FIG. 5A as a handle bar 44 for gripping by the extremities of the trainee.

Connected to the second end 42*b* of the elongated connector cable are novel resistance means for yieldably resisting telescopic movement of the connector cable relative to the arm assembly 22 (FIG. 1). The details of construction and operation of this novel resistance means will be discussed in the paragraphs that follow.

Figures 5B, 7:
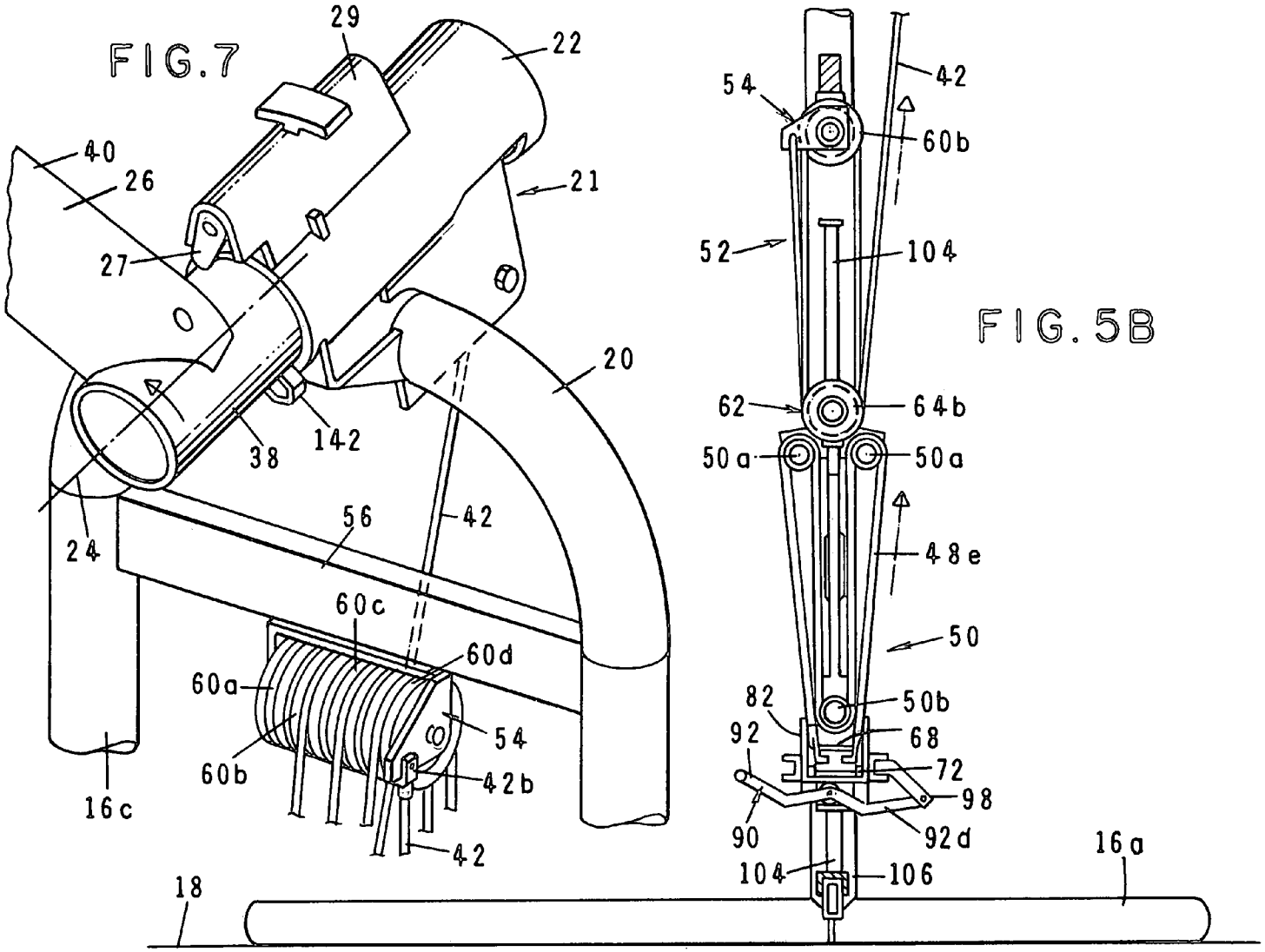
FIG. 7 is an enlarged, fragmentary, generally perspective view of the upper portion of the apparatus.
Figure 9A:
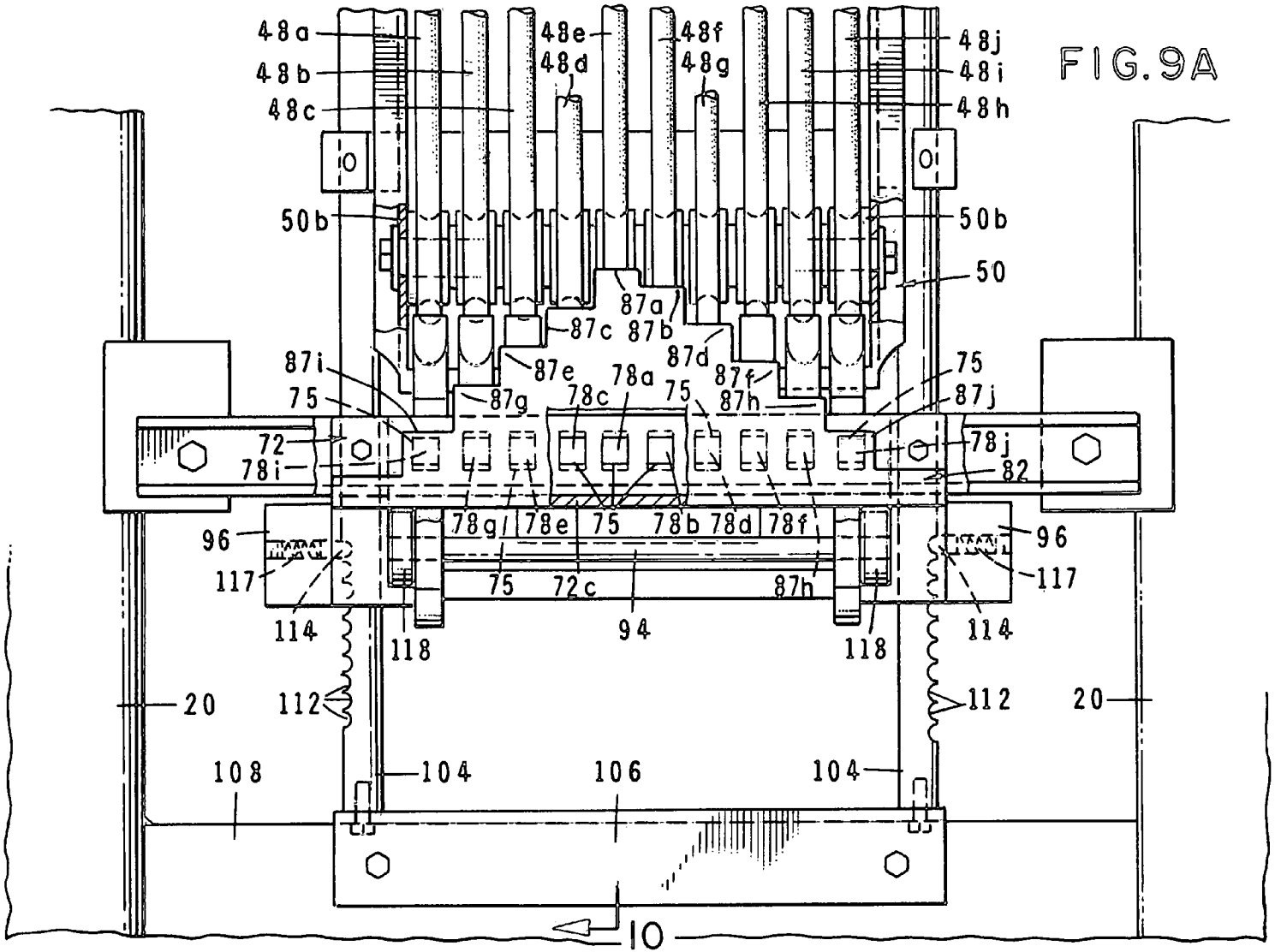
FIGS. 9A and 9B, when considered together, comprise an enlarged, fragmentary view taken along lines 9-9 of FIG. 8.
Figure 9B:
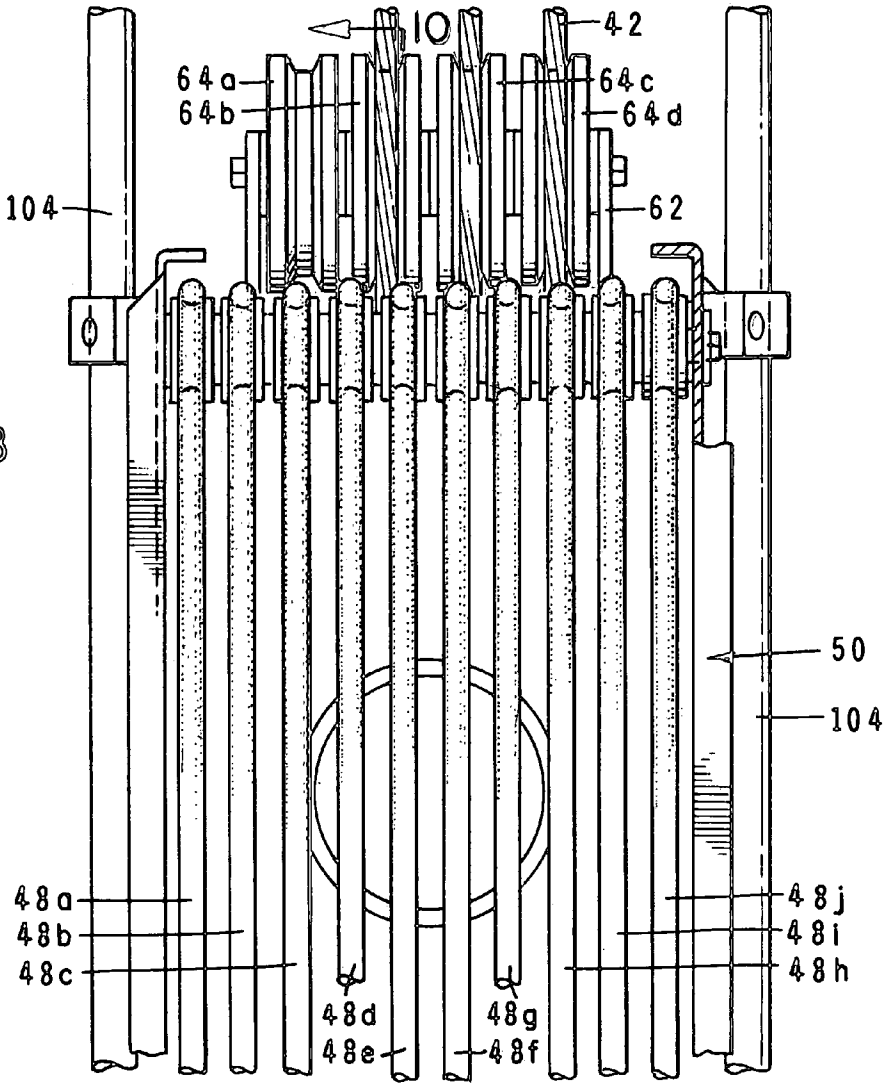

In the present form of the invention the resistance means comprises a plurality of side-by-side stretchable members 48*a*, 48*b*, 48*c*, 48*d*, 48*e*, 48*f*, 48*g*, 48*h*, 48*i* and 48*j* that are carried by a lower assemblage generally designated by the numeral 50 (FIGS. 1 and 9A). Also forming a part of the resistance means of the invention is an upper assemblage, generally designated by the numeral 52 (FIGS. 1 and 9B). Upper assemblage 52 is operably associated with lower assemblage 50 and functions to interconnect the lower assemblage 50 with the second end 42*b* of the elongated connector cable 42. In the present form of the invention upper assemblage 52, which is similar in construction and operation to a conventional block and tackle, comprises a first block 54 that is connected to a cross-member 56 that spans the spaced-apart, upstanding legs 16*c* of supporting frame 16. Rotatably mounted on first block 54 are adjacently disposed pulleys 60*a*, 60*b*, 60*c* and 60*d* (FIGS. 1 and 7). As best seen in FIG. 1, upper assemblage 52 also includes a second block 62 that is vertically spaced from the first block and is connected to the lower assemblage 50. Rotatably mounted on second block 62 are adjacently disposed pulleys 64*a*, 64*b*, 64*c* and 64*d*. As shown in FIG. 1, when the apparatus is assembled, the elongated connector cable 42 is successively entrained about pulley 64*a*, pulley 60*a*, pulley 64*b*, pulley 60*b*, pulley 64*c*, pulley 60*c*, pulley 64*d* and pulley 60*d* and then the second end 42*b* is connected to block 54. With this construction, a pulling force exerted by the trainee on the first end 42*a* of the elongated connector cable will cause the mechanically advantaged lifting of the lower assemblage 50 against the urging of the stretchable members carried by a lower assemblage 50.

Figure 8:
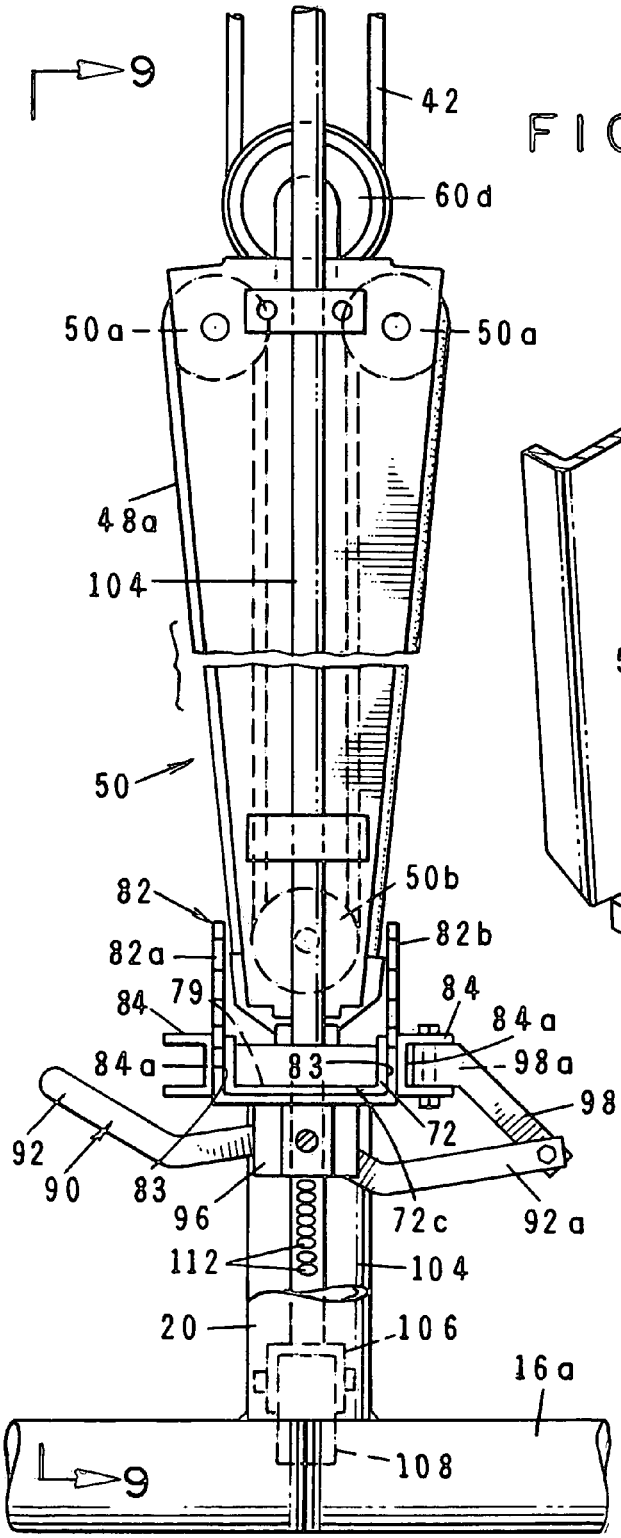
FIG. 8 is an enlarged, fragmentary side view of a portion of the resistance means of the apparatus.
Figure 11:
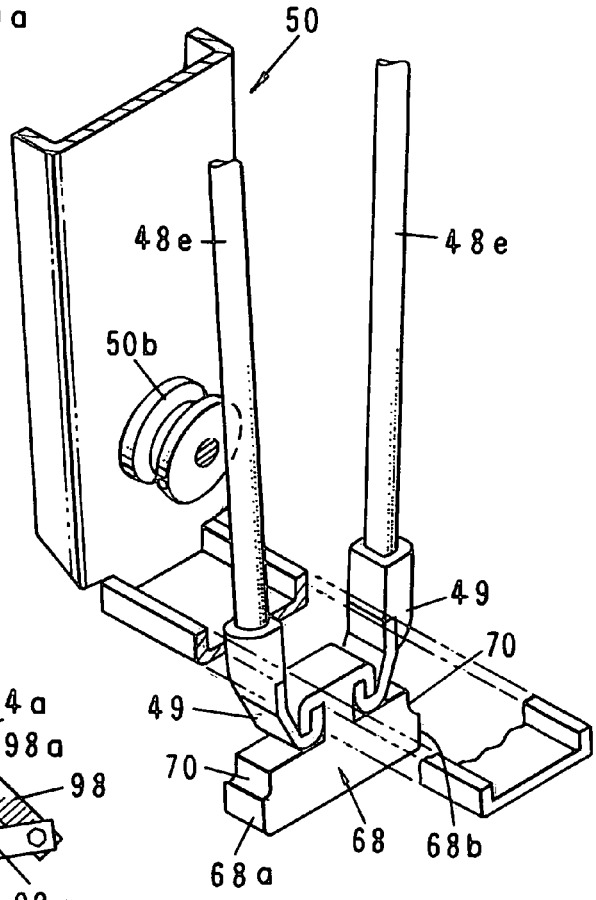
FIG. 11 is a fragmentary perspective view of a portion of the resistance means of the invention, including a perspective view of one of the elastomeric cords of the resistance means.
Figure 10A:
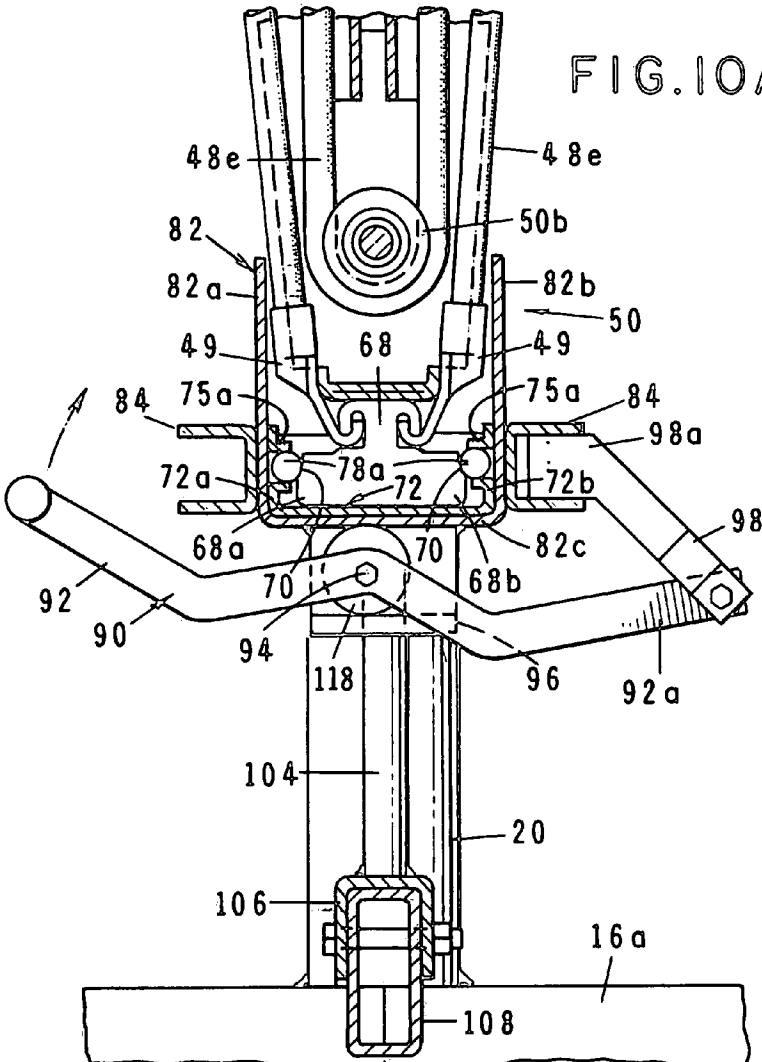
FIGS. 10A and 10B, when considered together, comprise an enlarged, fragmentary view taken along lines 10-10 of FIGS. 9A and 9B.
Figure 10B:
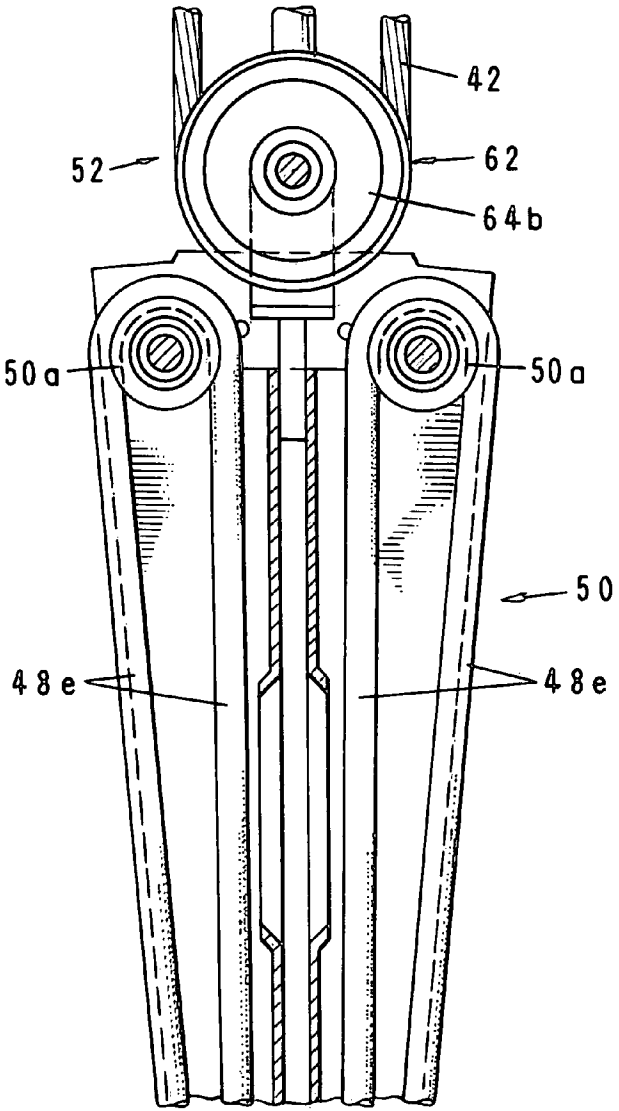

As illustrated in FIG. 8, each of the stretchable members 48*a*, 48*b*, 48*c*, 48*d*, 48*e*, 48*f*, 48*g*, 48*h*, 48*i* and 48*j* is entrained over a pair of spaced-apart upper pulleys 50*a* and under a lower pulley 50*b*. A connector element 68, which is of the unique configuration shown in FIGS. 5B and 10A, is connected to the extremities of each of the stretchable members by a pair of connector hooks 49 (FIG. 10A). It is to be understood that the stretchable members 48 can be interconnected with their respective connector elements 68 by various types of connectors. As best seen in FIG. 10A, each connector element 68 includes first and second curved edge portions 68*a* and 68*b*, which are provided with roller-receiving grooves or roller-receiving cavities 70 (see also FIG. 11), the function of which will presently be described. It is to be understood that various types of connectors can be used to connect the stretchable members with connector element 68.

Figure 15:
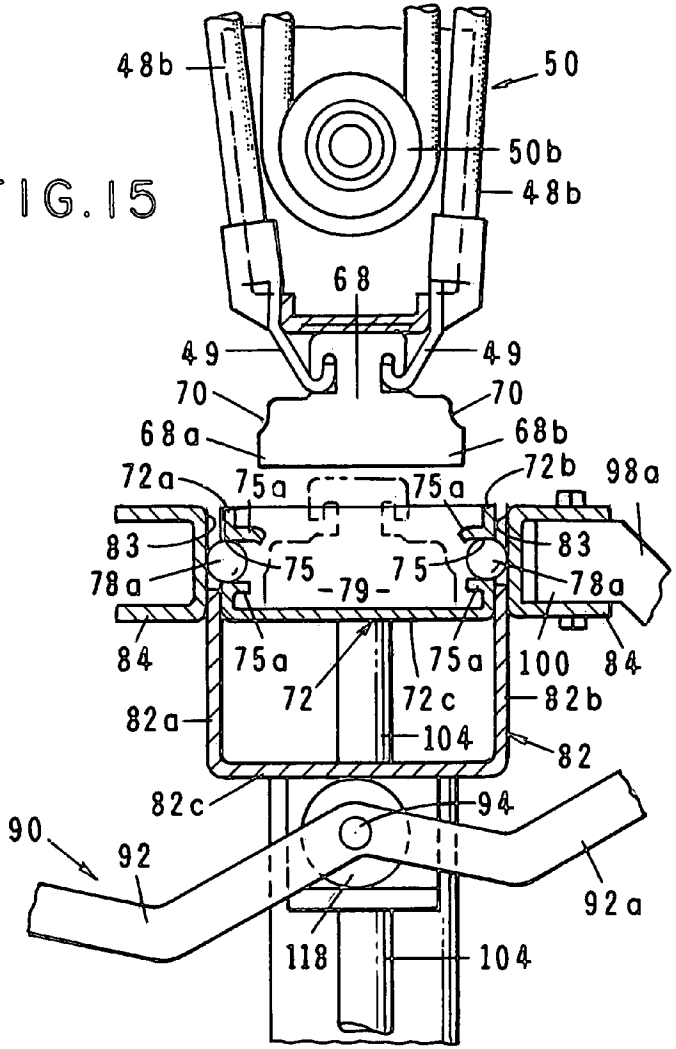
FIG. 15 is a cross-sectional view similar to FIG. 14A but showing one of the elastomeric cords disconnected from the selector means of the invention.
Figure 17:
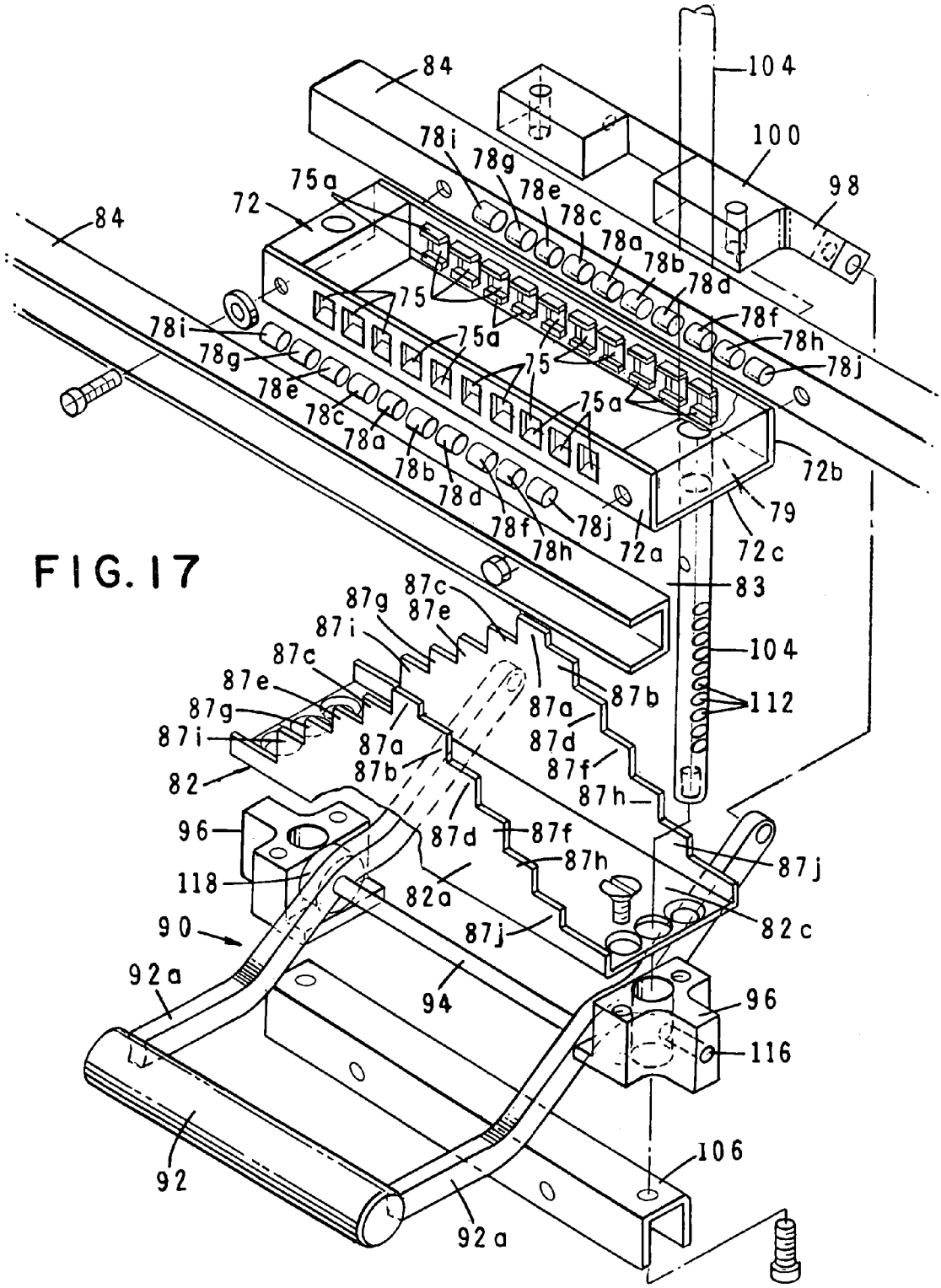
FIG. 17 is a generally perspective, exploded view of a portion of the selector means of the invention.

Lower assemblage 50 also includes receiving means for receiving connector elements 68. This receiving means here comprises a rigid plastic or metal housing 72 having first and second spaced-apart sidewalls 72*a* and 72*b* (FIGS. 10A and 17). Each side wall is provided with a plurality of spaced-apart, specially configured apertures 75 (FIGS. 9A and 17) which are adapted to closely receive a selected one of a plurality of interengaging members or rollers 78 which are movable within the roller-receiving openings or apertures 75 from a first retracted position to the second connector element engagement position shown in FIG. 10A. As indicated in FIGS. 10A and 15, housing 72 also includes a bottom wall 72*c* which, in cooperation with side walls 72*a* and 72*b*, define a connector element receiving chamber 79. To retain the rollers within apertures 75, each of the apertures is provided with inwardly extending, lanced-out portions 75*a* (FIG. 15). Portions 75*a* function to retain rollers 78 within apertures 75 while at the same time permitting them to move inwardly of chamber 79 toward the connector element engagement position shown in FIG. 10A. As indicated in FIG. 10A, as rollers 78 move into the second inward position they enter the grooves 70 provided in connector elements 68 and, in this way, function to securely interlock together the connector element and housing 72 of the connector means.

Forming an important aspect of the apparatus of the present invention is a selector means which functions to move selected rollers 78 into locking engagement with selected connector elements 68. In the present embodiment of the invention, the selector means comprises a selector member 82 having spaced-apart walls 82*a* and 82*b* which are interconnected by a base 82*c*. As best seen by referring to FIGS. 9A and 17, the side walls of selector member 82 are formed in a generally stair-step configuration with each wall being provided with a plurality of parallel roller-engaging bands or areas which are adapted to selectively engage rollers 78 as the selector member 82 moves in an upward direction toward housing 72 of the connector means. More specifically, in a manner presently to be described, selector member 82 is movable between first and second positions with the side walls thereof moving into spaces 83 formed between the side walls 72*a* and 72*b* of housing 72 and the inboard walls 84*a* of a pair of channel-like members 84 which are connected to upstanding portion 20 and are disposed on either side of connector housing 72. As walls 82*a* and 82*b* of the selector member move into spaces 83 in the manner shown in FIGS. 13A and 14A, they will selectively engage rollers 78 tending to force the rollers inwardly of apertures 75 and into locking engagement with selected connector elements 68.

Turning now particularly to FIGS. 9A, 10A and 17, the connector means here include a first pair of spaced-apart, generally centrally disposed rollers 78*a*, a second pair of spaced-apart rollers 78*b* disposed on one side of the first pair of rollers, and a third pair of spaced-apart rollers 78*c* disposed on the opposite side of the first pair of rollers. A fourth pair of spaced-apart rollers 78*d* is disposed proximate second pair of rollers 78*b* and a fifth pair of spaced-apart rollers 78*e* is disposed proximate third pair of rollers 78*c*. Similarly, a sixth pair of rollers 78*f* is disposed proximate rollers 78*d*, and a seventh pair of rollers 78*g* is disposed proximate rollers 78*e*. In like manner, an eighth pair of rollers 78*h* is disposed proximate rollers 78*f* and a ninth pair of rollers 78*i* is disposed proximate rollers 78*g*. Finally, a tenth pair of rollers 78*j* is disposed proximate rollers 78*h*. It is to be understood that any number of rollers can be used depending upon the desired size and end-use of the apparatus.

As also shown in FIGS. 9A, 10A and 17, walls 82*a* and 82*b* of selector member 82 are each provided with a generally centrally disposed first roller-engaging band 87*a* that is adapted to engage rollers 78*a* when selector member 82 is in its first position. With the selector member in this first position, bands 87*a* force rollers 78*a* into locking engagement with roller-receiving grooves or roller-receiving cavities 70, of the connector element 68 which is attached to the generally centrally disposed elastomeric cord 48*e* so that an upward movement of upper assemblage 52 will cause cord 48*e* to stretch in a manner to yieldably resist such upward movement.

Walls 82*a* and 82*b* are also provided with a second pair of spaced-apart bands 87*b*, which is disposed on one side of first pair of bands 87*a*. These second bands are adapted to engage second pair of rollers 78*b* in a manner to urge the rollers inwardly of apertures 70*b*. A third pair of spaced-apart bands 87*c* is disposed on the opposite side of first pair of bands 87*a* and is adapted to engage third pair of rollers 78*c*. Similarly, a fourth pair of spaced-apart bands 87*d* is disposed proximate second pair of bands 87*b*, and is adapted to engage fourth pair of rollers 78*d*, while a fifth pair of spaced-apart bands 87*e* is disposed proximate third pair of bands 87*c*, these latter bands being adapted to engage fifth pair of rollers 78*e*. In like manner, walls 82*a* and 82*b* are provided with a sixth pair of bands 87*f* located adjacent bands 87*d*, a seventh pair of bands 87*g* located adjacent bands 87*e*, an eighth pair of bands 87*h* located adjacent bands 87*f*, a ninth pair of bands 87*i* located adjacent bands 87*g* and a tenth pair of bands 87*j* located adjacent bands 87*h*. Bands 87*f*, 87*g*, 87*h*, 87*i*, and 87*j* are adapted to engage rollers 78*f*, 78*g*, 78*g*, 78*h*, 78*i*, and 78*j* respectively as selector member 82 is moved toward connector housing 72. As these bands engage their respective rollers, the rollers will move into locking engagement with the connector elements 68 located proximate the rollers.

Figure 13A:
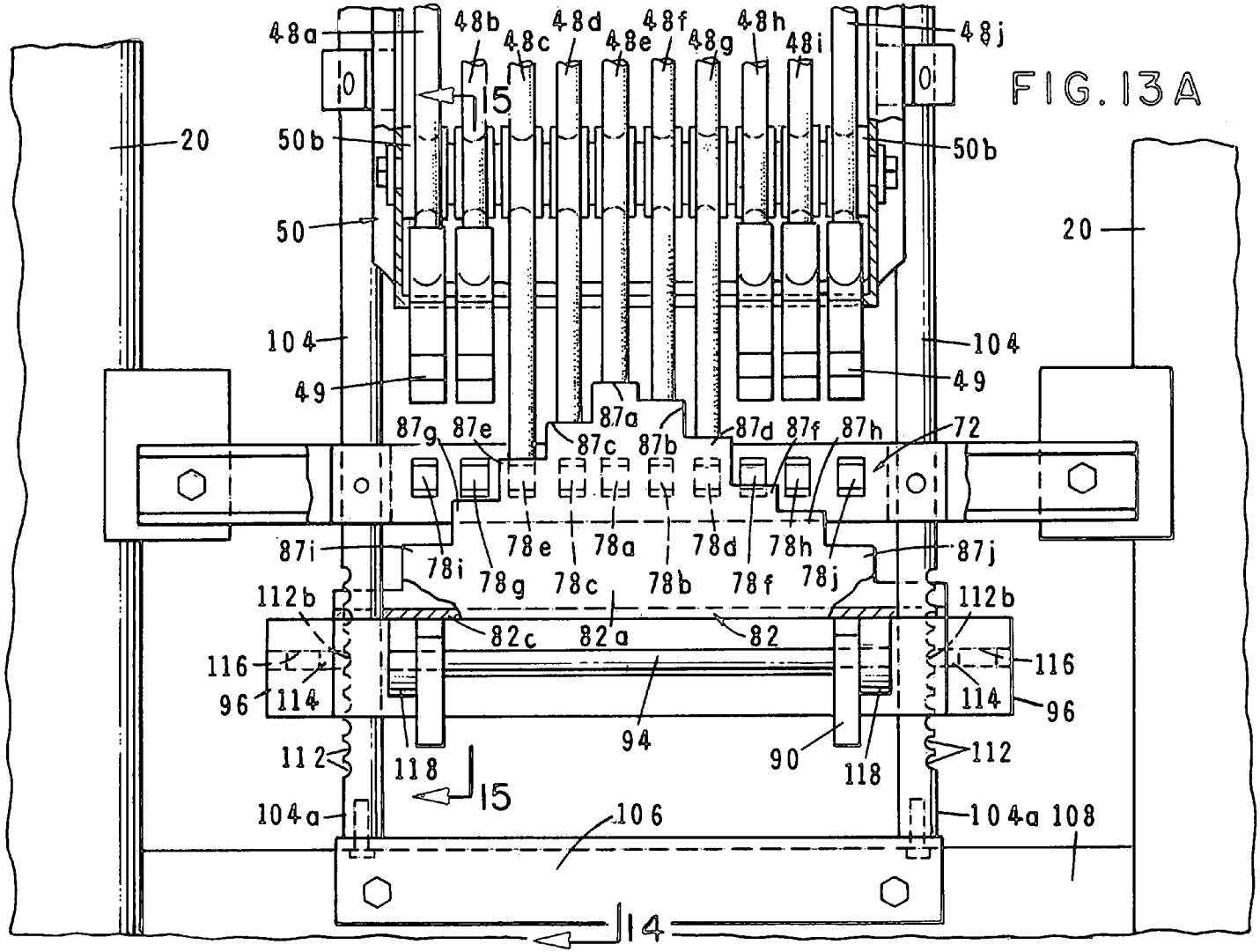
FIGS. 13A and 13B, when considered together, comprise a front view of a portion of the resistance means of the invention partly broken away to show internal construction.
Figure 13B:
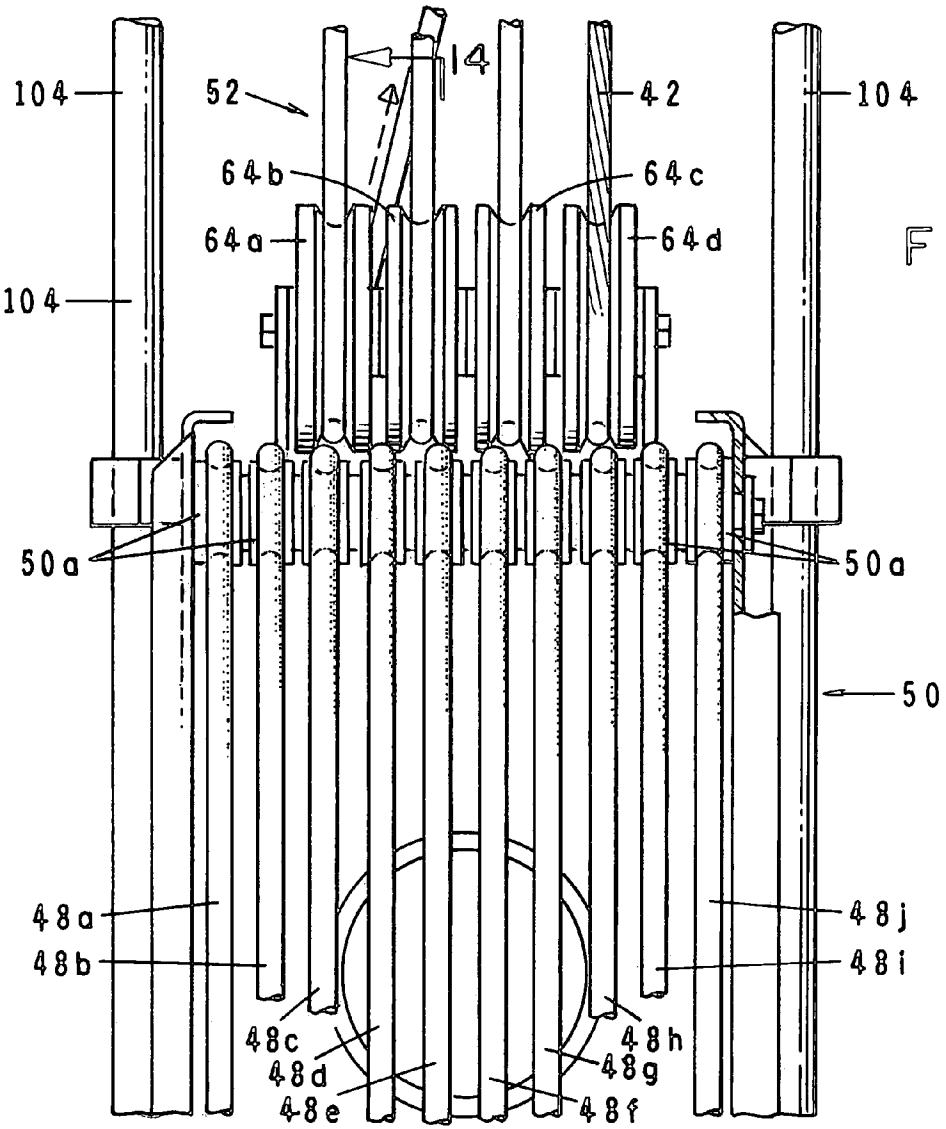

For example, as illustrated in FIG. 13A, as selector member 82 is moved upwardly toward housing 72 to the intermediate position there shown, bands 87*b* and 87*c* will engage rollers 78*b* and 78*c* in a manner to move them into locking engagement with the connector elements that are connected to cords 48*f* and 48*d* respectively. This movement now couples cords 48*c* and 48*g* along with cord 48*e*, to housing 72 so that upward movement of upper assemblage 52 will cause cords 48*c*, 48*d*, 48*e*, 48*f*, and 48*g* to stretch in a manner to yieldably resist such upward movement of upper assemblage 52 in the direction of the arrow 83 of FIG. 1 will be resisted by the combined resistance of the five elastomeric cords.

Continued movement of selector member 82 toward housing 72 will cause bands 87*g* and 87*h* to move into engagement with rollers 78*g* and 78*f* so as to urge these rollers into locking engagement with the connector elements 68 that are connected to cords 48*b* and 48*h* and are disposed within chamber 79 proximate rollers 78*g* and 78*f*. This movement couples these cords, along with cords 48*c*, 48*d*, 48*e*, 48*f* and 48*g* to resist movement to housing 72 so that upward movement of upper assemblage 52 will now be resisted by the combined resistance offered by the seven elastomeric bands coupled to housing 72. In like manner, further movement of selector member 82 toward mating engagement with housing 72 will cause bands 87*i*, 87*h* and 87*j* to engage rollers 78*i*, 78*h* and 78*j*, thereby coupling three more cords to the housing 72. With the selector member in this final, second position, all of the cords are coupled with housing 72 thereby providing maximum resistance to the upward movement of upper assemblage 52. Elastomeric cords 48 can be of the same or different elasticity so that various incremental resistance loads can be obtained as the elastomeric cords are sequentially coupled with housing 72 and with the body-engaging means, here shown as gripping handle 44 that is connected to the first end 42*a* of the elongated connector cable 42. It is apparent that movement of selector member 82 away from housing 72 will permit sequential disconnection of the elastomeric cords from housing 72 thereby decreasing the resistance offered to movement of the body-engaging means.

Figure 14A:
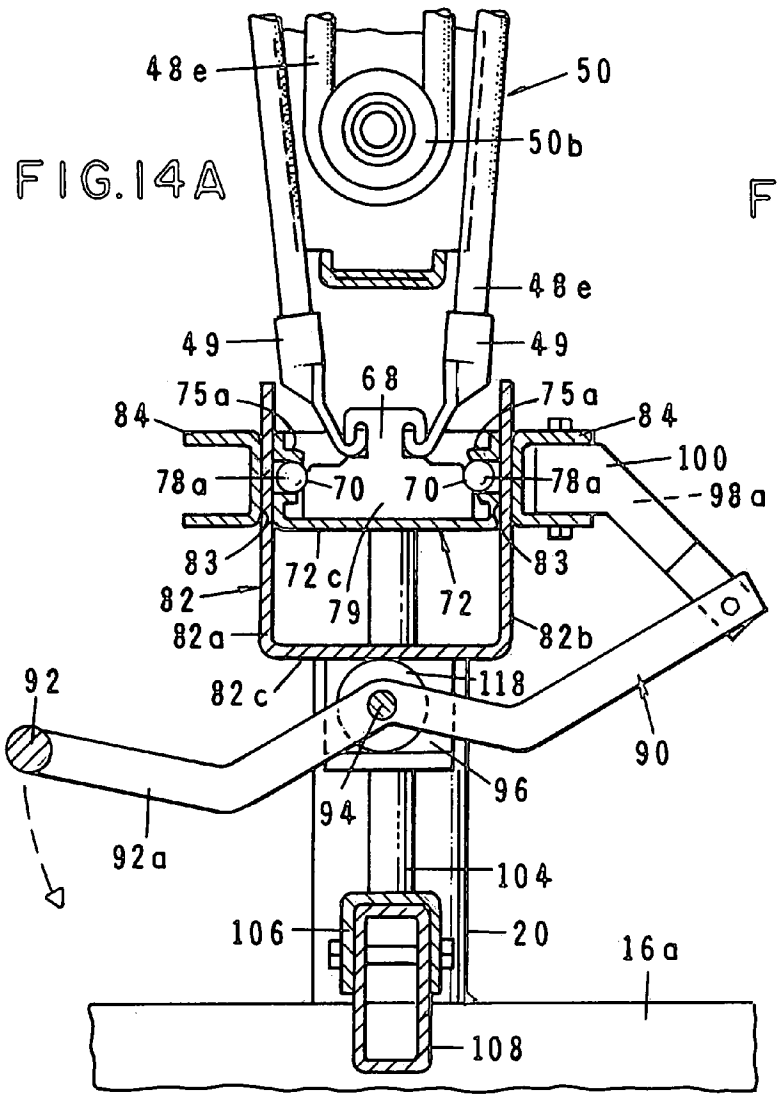
FIGS. 14A and 14B, when considered together, comprise a cross-sectional view taken along lines 14-14 of FIGS. 13A and 13B.

In order to move the selector member between the first and second positions, a novel actuating means is provided. In the present form of the invention, this actuating means comprises an actuating assembly made up of an actuating arm assembly 90 that comprises a generally U-shaped lifting arm 92 which is pivotally connected to a shaft 94 that spans a pair of spaced-apart bushings 96, the purpose of which will presently be described. The leg portions 92*a* of the U-shaped arm 92 are, in turn, pivotally interconnected with a second pair of arms 98, the extremities 98*a* of which are connected to a transversely extending connector bar 100 that is connected to one of the channel-like members 84 (FIGS. 14A and 17). The arm assembly 90 can, of course, be constructed in various sizes and configurations.

Turning once again to FIGS. 1, 13A and 17, it is to be noted that a pair of upstanding, spaced-apart guide rods 104 are connected proximate their lower ends 104*a* to a channel-shaped member 106 that is in turn connected to a cross-member 108 that spans base portion 16*a*. Slidably receivable over guide rods 104 are the previously identified bushings 96 (See FIGS. 12 and 17). With this construction, as a lifting force is applied to the lifting arm 92 of actuator arm assembly 90, bushing 96 will slide along guide rods 104 and, in so doing, will cause the pivotally connected arm 98 to move selector member 82 toward or away from the roller carrying housing 72 of the connector means (See FIG. 10A). As previously mentioned, as selector member 82 moves toward housing 72 and toward the rollers 78 carried thereby, bands 87 of the selector member will sequentially engage the rollers in a manner to urge them inwardly into locking engagement with the connector elements 68 that are connected to the lower ends of the various elastomeric cords 48.

Figure 12:
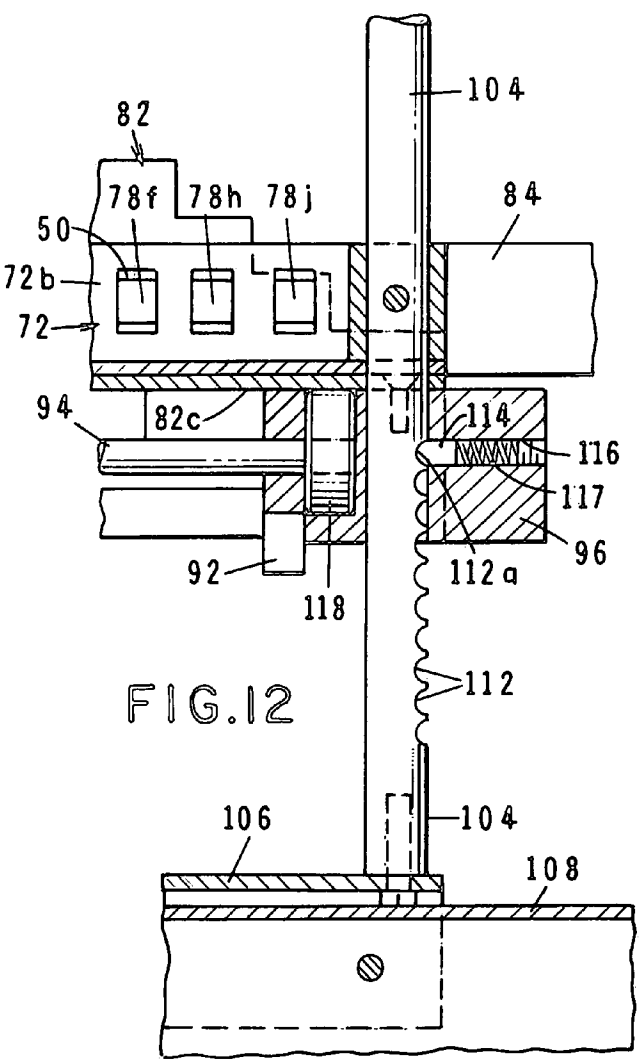
FIG. 12 is a fragmentary, side-elevational view of a portion of the resistance means of the invention and a one of the guide columns of the invention.

To position selector member 82 at selected locations relative to connector housing 72, spring-biased locking means are provided. In this regard, each of the guide rods 104 is provided with a plurality of spaced-apart pin-receiving cavities 112 which are adapted to receive the inboard ends of a pair of spring-loaded securement pins 114 which form a part of the securement means of the present embodiment of the invention. Pins 114 are carried within bores 116 provided in each of the bushings 96 and are biased inwardly by a spring 118 (FIGS. 12 and 13A). With this construction, as bushings slide along guide rods 104, they will smoothly ratchet into cavities 112. Cavities 112 are spaced-apart so as to correspond with the sequential engagement of bands 87 of the support member as the bands are moved into actuating engagement with the rollers 78.

The construction of the securement pin assemblies is such that, as lifting arm 92 is lifted, the trainee will experience a precise, ratchet-like, tactile sensation as each level of movement of the selector member toward housing 72 is accomplished. For example, by referring to FIG. 9A it can be seen that when the pin assemblies are in engagement with the first cavities 112*a*, all of the bands 87 of the selector member 82 are in engagement with the rollers 78.

However, when the lifting arm is moved to the position shown in FIG. 13A placing pin assemblies in engagement with cavities 112*b*, bands 87*a*, 87*b*, 87*c*, 87*d*, and 87*e* have been moved into engagement with rollers 78*a*, 78*b*, 78*c*, 78*d*, and 78*e* respectively, thereby interconnecting elastomeric cords 48*c*, 48*d*, 48*e*, 48*f*, and 48*g* with housing 72. With the apparatus of the invention in this position, any upward movement of the housing will be resisted by the five elastomeric cords just identified. As the lifting arm assembly continues to urge selector member 82 toward connector housing 72, the securement means, or pin assemblies 114 will sequentially ratchet into engagement with the higher cavities 112 provided in the guide rods 104 so as to support the selector member in the desired position. To assist in the smooth upward movement of selector member 82, by lifting arm assembly 90, a pair of rollers 118 is disposed intermediate the bottom wall of the selector member.

It is apparent that a number of different types of exercises can be performed with the apparatus in the various configurations shown in the drawings. For example, with the arm assembly 26 in the position shown in FIG. 3 by the solid lines, various overhead pulling exercises, such as the latissimus muscle exercises and other upper body exercises can be performed by pulling downwardly on handle 44 against the urging of the resistance means. In the preferred form of the invention the first end 42*a* of the cable is able to travel about 52 inches for latissimus muscle exercises. It is to be observed that with the arm assembly in the upraised position shown in FIG. 3, cable 42 is entrained about a pulley 122 that is rotatable connected to a housing 124 that is, in turn, connected to arm 40. Next, cable 42 extends through arm 40, under a pulley 122*a*, through sleeve 38 and over a pulley 122*b* (See FIGS. 5A and 16). Pulleys 122, 122*a* and 122*b* comprise a part of the pulley means of the invention for operably interconnecting the cable 42 with assembly 52.

With the arm assembly 26 in the intermediate positions shown by the phantom lines of FIG. 3, as for example positions 33 and 145, various arm, back and shoulder exercises can be performed against the resistance of the resistance means by pulling outwardly and downwardly on handle 44. As previously discussed, because of the unique angular positioning of arm 40 relative to hub 26, when the arm is in these intermediate positions, the outermost pulley 122 about which the cable 42 is entrained is conveniently positioned outside the footprint of base 16*a* so that the base assembly will not interfere with the performance of the exercises.

Figure 18:
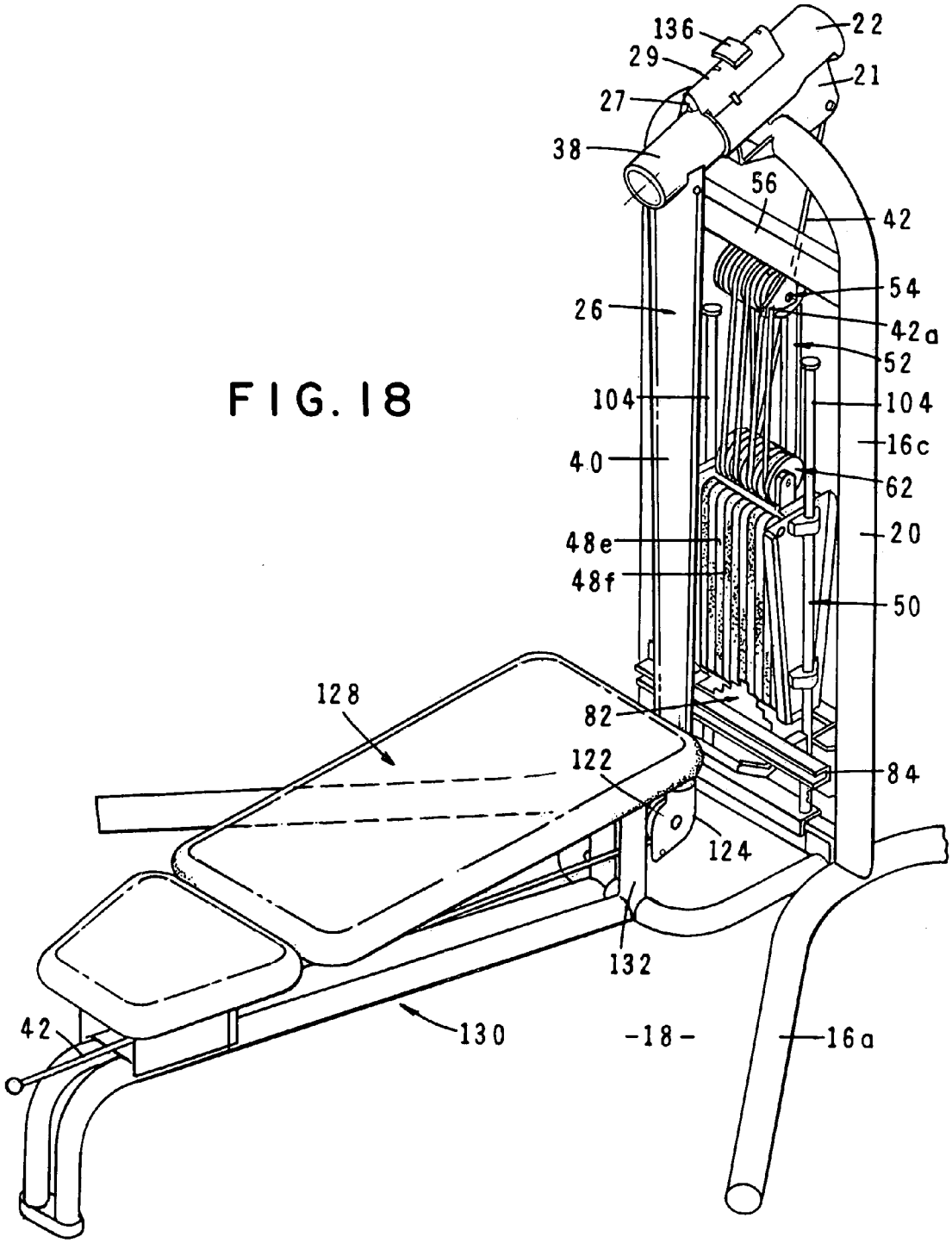
FIG. 18 is a generally perspective view of an alternate form of the apparatus of the invention which includes the provision of an exercising bench.

With the arm assembly 26 in the intermediate positions 35 and 147, a number of other arm; leg and back exercises can be performed with or without the use of the bench assembly 128 shown in FIG. 18 by pulling outwardly on handle 44. Bench assembly 128, which is of a conventional construction, comprises a floor engaging tubular support structure 130 and a body support assembly 132 that is supported by the support structure.

With the apparatus in the configuration shown in FIG. 18, cable 42 passes under pulley 122 and extends underneath the bench assembly so that various types of leg and lower body exercises can readily be performed against the urging of the resistance means.

In summary, it is to be appreciated that the arm assembly 26 can uniquely be articulated from overhead to shoulder width at the side to behind the trainee at its lowest position with each position being ideal for the performance of a given exercise.

Figure 16:
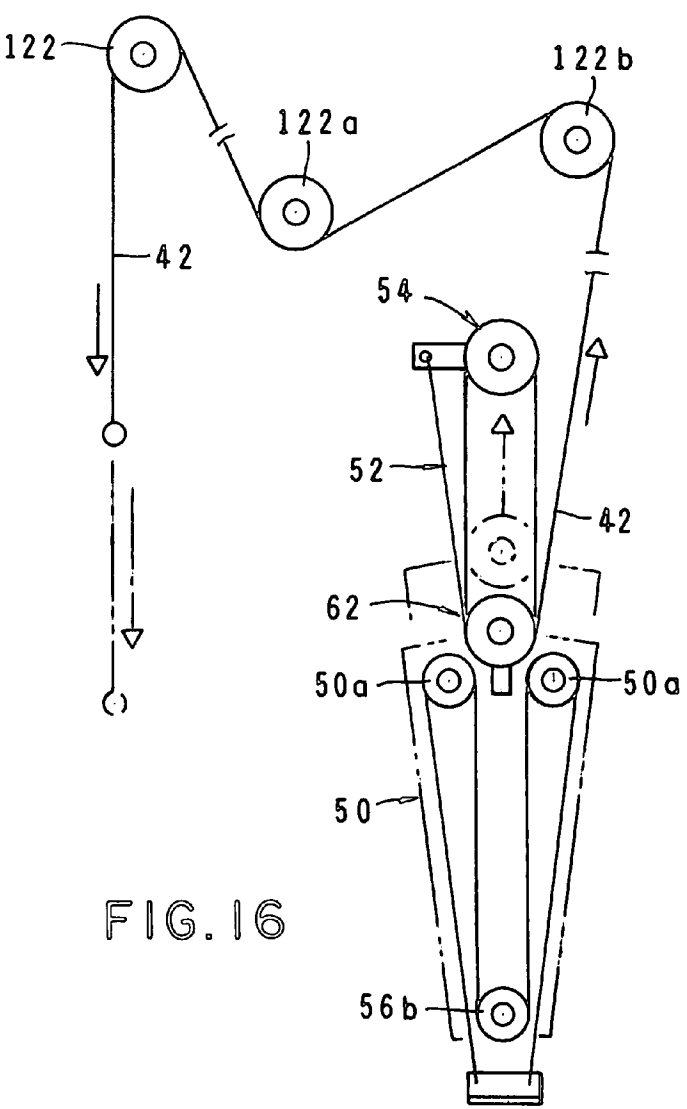
FIG. 16 is a generally diagrammatic, side-elevational view illustrating the path of the connector cable of the apparatus through the pulley system of the apparatus.
Figure 14B:
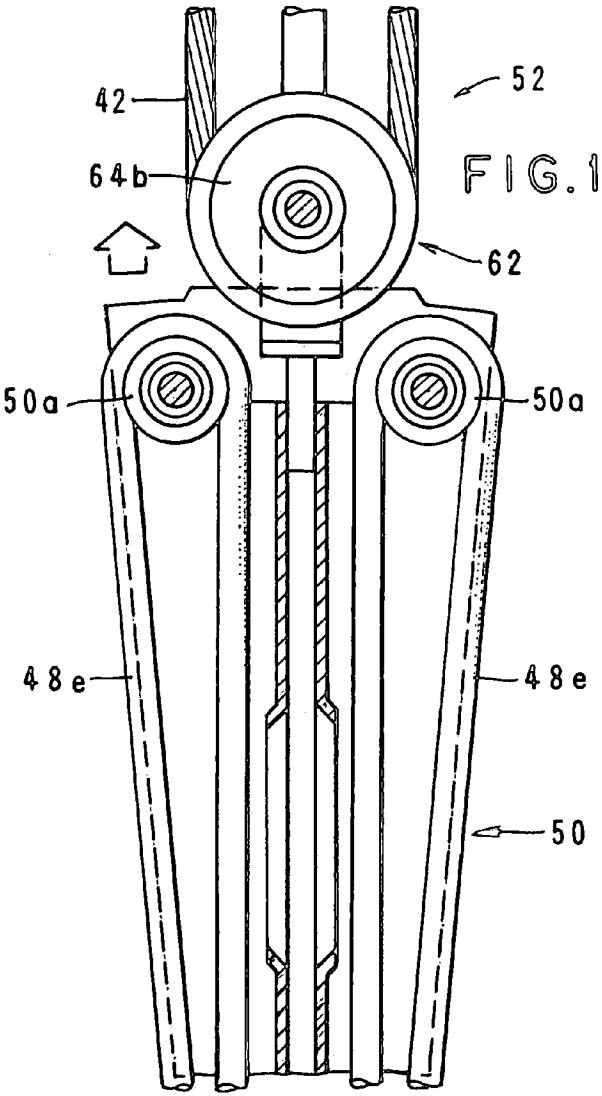

In the form of the apparatus of the invention shown in FIG. 1, cable 42 once again passes about pulleys 122, 122*a* and 122*b* so that a movement of the first body-engaging means or handle 44 in an outwardly and downwardly direction away from pulley 122 will cause a foreshortening of the cable in a manner to move second block 62 in an upwardly direction (See FIG. 16). Upward movement of block 62 will, in turn, cause an upward movement of lower assemblage 50 against the urging of the elastomeric cords that have been selectively interconnected with housing 72 in the manner previously described.

Referring particularly to FIGS. 3, 4, 5A and 6, when the trainee desires to move the arm assembly 26 from the raised position shown by the solid lines in FIG. 3 to a selected one of the intermediate positions shown by the phantom lines, the release member 136 of the locking means is pulled upwardly as illustrated by the phantom lines of FIG. 6 against the urging of biasing means shown here as an upwardly curved spring 137 that is connected to release member 136 in the manner shown in the drawings (See FIG. 5A). This upward movement of release member 136 moves a locking pin 138, which is selectably receivable within circumferentially spaced-apart bores 140 formed in sleeve 22 and hub 38 of the arm assembly. This upward movement of the release member permits rotation of the arm assembly within sleeve 22 so that, as indicated by the arrows 141 of FIG. 6, the arm assembly can be incrementally moved and locked in a plurality of intermediate positions to enable the performance of numerous types of upper and lower body exercises. When the arm assembly is rotated into a selection position, release of member 136 will securely lock the arm assembly in that selected position.

When the arm assembly 26 is in the lowered position shown in FIG. 6, the previously identified stop member 27 will, due to the urging of a generally "U"-shaped element 142 formed on hub 38, engage the wall of housing 29 in a manner to block further rotation of the arm assembly in a counterclockwise direction as viewed in FIG. 6. This action of the stop member prevents misalignment of cable 42 that could result from further counterclockwise rotation of the arm assembly. However, it is to be noted that stop member 27 will not prevent clockwise movement of the arm assembly from the location shown in FIG. 6, so that the arm assembly can be moved into the positions shown by the phantom lines in FIG. 3 that are identified by the numerals 145 and 147 as well as into a plurality of different intermediate positions. When, during this clockwise movement, the arm assembly reaches the lowered, generally vertical position, stop member 27 will engage the other side of housing 29 thereby blocking further clockwise movement of the arm assembly and preventing misalignment of cable 42. This unique feature of the apparatus of the invention that permits the arm assembly 26 to be moved incrementally and securely locked into a plurality of angular exercise positions provides versatility not found in prior art exercising devices.

Figure 19:
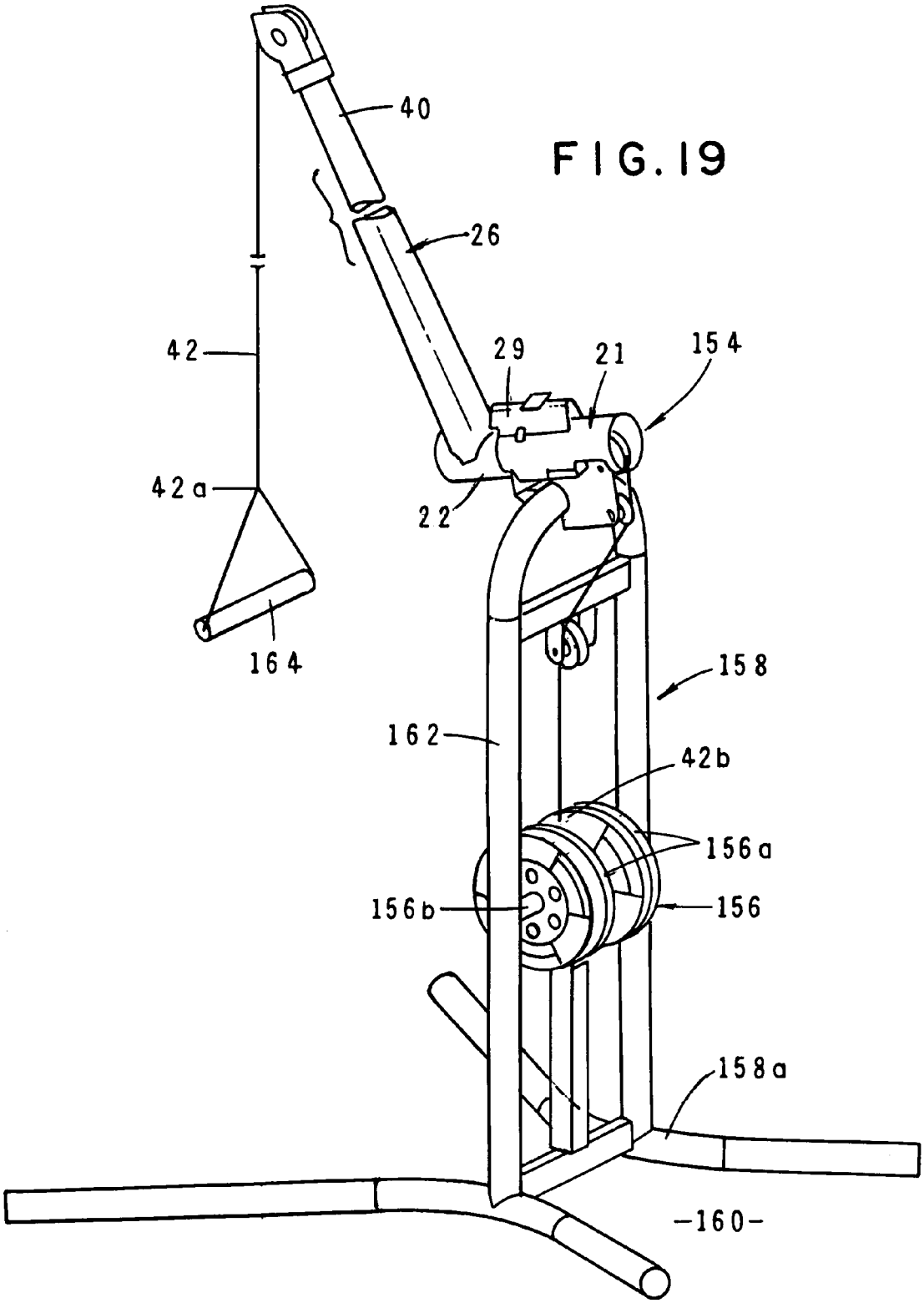
FIG. 19 is a generally perspective view of still another form of the exercise apparatus of the invention in which the novel pulley-carrying exercise arm is used with a set of conventional free weights.

Referring next to FIG. 19 of the drawings, still another form of the exercise apparatus of the present invention for use by a trainee in the performance of exercises is there illustrated and generally designated by the numeral 154. This latter form of the exercise apparatus is similar in many respects to the apparatus shown in FIGS. 1-7 of the drawings and like numerals are used in FIG. 19 to identify like components. The primary difference between this latest form of the invention and the earlier described forms of the invention resides in the fact that the arm assembly 26, which is identical in construction and operation to that previously described, is used in connection with a set of free weights 156.

The apparatus 154 here comprises a supporting frame 158 having a base portion 158*a* for engagement with a generally planar support surface defining a first plane 160 and an upstanding portion 162. Connected to upstanding portion 162 is a sleeve assembly 21 that includes a tubular sleeve 22 that is identical in construction to that previously described. Rotatably connected to tubular sleeve 22 for rotation relative thereto is the previously identified arm assembly 26.

A connector cable 42, which is carried by arm assembly 22 for telescopic movement therewithin, has first and second ends 42*a* (FIG. 5A) and 42*b* (FIG. 1). Connected to first end 42*a* of the elongated connector cable is gripping or body-engaging means for gripping by the trainee shown in FIG. 19 as a handle bar 164 for gripping by the extremities of the trainee.

Connected to the second end 42*b* of the elongated connector cable are the resistance means of this latest form of the invention for yieldably resisting telescopic movement of the connector cable relative to the arm assembly 22. As previously mentioned, this resistance means here comprises the conventional set of free weights 156 that are of the general configuration shown in FIG. 19. Free weights 156 here comprise a plurality of generally disc-shaped weights 156*a* that are removably mounted in conventional fashion on a transverse shaft 156*b*.

It is apparent that a downward force exerted on handlebar 164 will result in the upward travel of free weights 156. The degree of resistance offered by the free weights can be varied by adding or removing weights 156*a* from transverse shaft 156*b*.

In the manner previously described, the exercise arm can be incrementally rotated between a high latissimus exercise position into a low exercise position and also can be rotated into various intermediate positions. As before, this unique feature permits the proper performance of a number of different upper body, arm and leg exercises.

Figure 20:
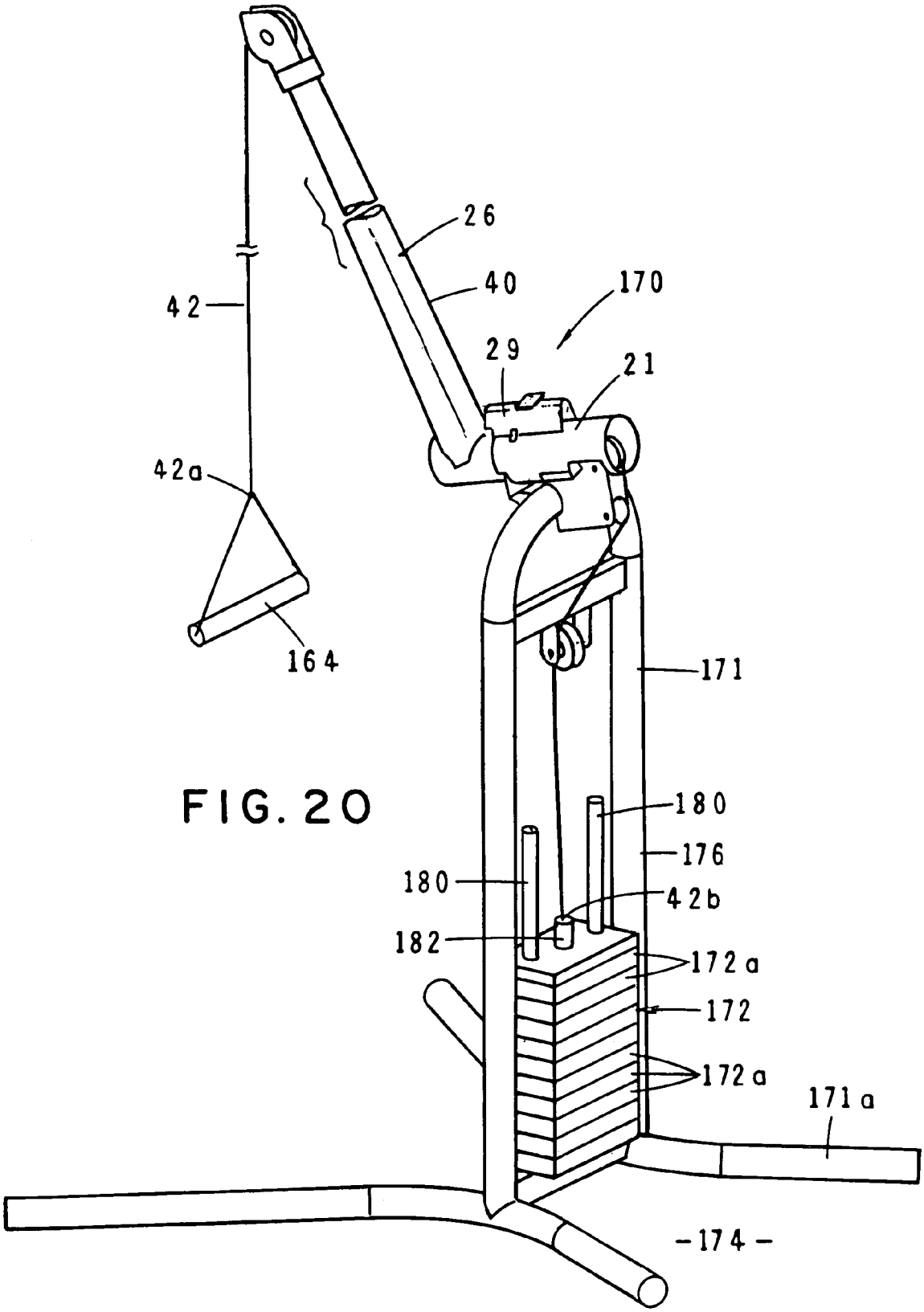
FIG. 20 is a generally perspective view of yet another form of the exercise apparatus of the invention in which the novel pulley-carrying exercise arm is used with a conventional selectorized weight stack.

Turning to FIG. 20 of the drawings, yet another form of the exercise apparatus of the present invention for use by a trainee in the performance of exercises is there illustrated and generally designated by the numeral 170. This latter form of the exercise apparatus is also similar in many respects to the apparatus shown in FIGS. 1-7 of the drawings, and like numerals are used in FIG. 20 to identify like components. The primary difference between this latest form of the invention and the earlier described forms of the invention resides in the fact that the arm assembly 26, which is identical in construction and operation to that previously described, is used in connection with a set of selectorized weights 172.

The apparatus 170 here comprises a supporting frame 172 having a base portion 172*a* for engagement with a generally planar support surface defining a first plane 174 and an upstanding portion 176. Connected to upstanding portion 176 is a sleeve assembly 21 that includes a tubular sleeve 22 that is identical in construction to that previously described. Rotatably connected to tubular sleeve 22 for rotation relative thereto is the previously identified arm assembly 26.

Connector cable 42, which is carried by arm assembly 26 for telescopic movement therewithin, has first and second ends 42*a* and 42*b*. Connected to first end 42*a* of the elongated connector cable is gripping or body-engaging means for gripping by the trainee shown in FIG. 19 as a handle bar 164 for gripping by the extremities of the trainee.

Connected to the second end 42*b* of the elongated connector cable are the resistance means of this latest form of the invention for yieldably resisting telescopic movement of the connector cable relative to the arm assembly 26. As previously mentioned, this resistance means here comprises a conventional set of selectorized weights 172 that are of the general configuration shown in FIG. 20. Selectorized weights 172 here comprise a plurality of stacked weights 172*a*, the vertical travel of which is guided by a pair of transversely spaced-apart guide rods 180 that are mounted within upstanding portion 176. A selector post 182 extends upwardly through holes in the weights 172*a* and, along with a selector pin (not shown), provides the means for selecting the number of weights to be lifted. This type of selectorized system is well known in the art and such a system as described in the previously mentioned U.S. Pat. No. 3,912,263 issued to Yatso. Reference should be made to this latter patent for a discussion of the details concerning the manner in which the number of weights to be lifted can be selected.

With the construction described in the preceding paragraphs, it is apparent that a downward force exerted on handlebar 164 will result in the upward travel of one or more of the weights 172*a*.

In the manner previously described, the exercise arm can be incrementally rotated between a high latissimus exercise position into a low exercise position and also can be rotated into various intermediate positions. As before, this unique feature permits the proper performance of a number of different upper body, arm and leg exercises.

Figure 21:
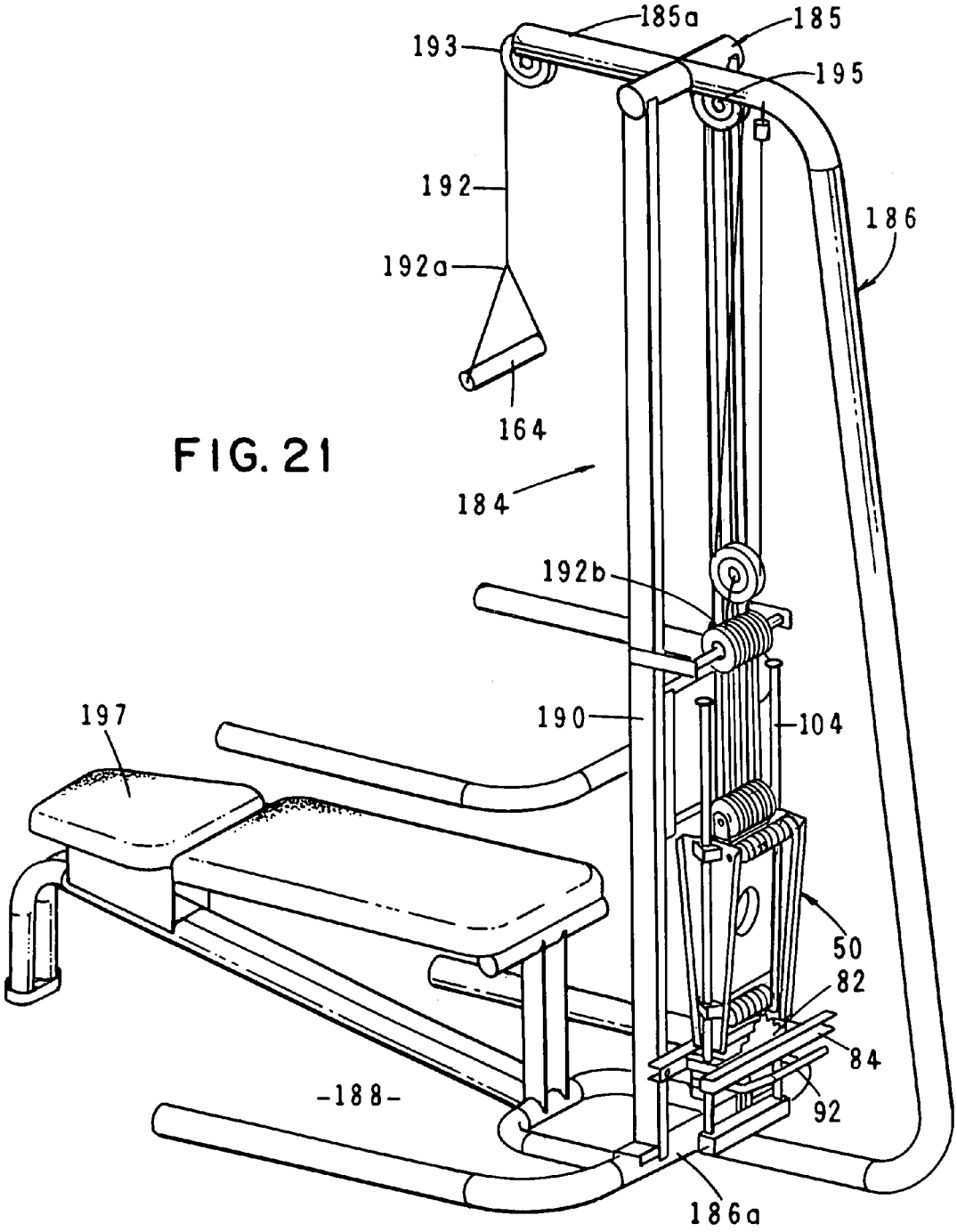
FIG. 21 is a generally perspective view of still another form of the exercise apparatus of the invention in which the elastomeric cord-type resistance module of the invention is used with a conventional, nonrotating pulley carrying exercise arm.

Referring next to FIG. 21 of the drawings, still another form of the exercise apparatus of the present invention for use by a trainee in the performance of exercises is there illustrated and generally designated by the numeral 184. This latter form of the exercise apparatus is also similar in certain respects to the apparatus shown in FIGS. 1-7 of the drawings and like numerals are used in FIG. 21 to identify like components. The primary difference between this latest form of the invention and the earlier described forms of the invention resides in the fact that a conventional type of non-rotating arm assembly 186 is operably interconnected with the resistance means, which, in this embodiment, is identical in construction and operation to that shown in FIG. 1 of the drawings and previously described herein.

The apparatus 184 here comprises a supporting frame 186 having a base portion 186*a* for engagement with a generally planar support surface defining a first plane 188 and an upstanding portion 190. Connected to upstanding portion 190 is the previously mentioned, conventional type of non-rotating lifting arm 186 that comprises a generally cylindrically shaped, tubular sleeve 186*a*.

A connector cable 192, which is entrained about pulleys 193 and 195 that are carried by arm assembly 186 is adapted for telescopic movement within arm 186. Connector cable 192 has first and second ends 192*a* and 192*b*. Connected to first end 192*a* of the connector cable is gripping or body-engaging means for gripping by the trainee shown in FIG. 21 as a handle bar 164 for gripping by the extremities of the trainee.

Connected to the second end 192*b* of the elongated connector cable are the resistance means of this latest form of the invention for yieldably resisting telescopic movement of the connector cable relative to arm 186. As previously mentioned, this resistance means is identical in construction and operation to that shown in FIG. 1 of the drawings and reference should be made to the description herein of the resistance means illustrated in FIGS. 1-18 of the drawings for the details of construction and operation of this important means. It is apparent that a downward force exerted on handle bar 164 will be resisted by the resistance means, which can be adjusted in the manner previously described herein.

As was the case with the embodiment of the invention illustrated in FIG. 18 of the drawings, this latter embodiment of the invention also includes a conventional type of bench assembly 197 that is disposed proximate frame portion 186*a* and functions to support the trainee during the performance of the various types of exercises previously discussed herein.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention as set forth in the following claims.

I claim:

1. An exercise apparatus for use by a trainee in the performance of exercises comprising:

(a) a supporting frame having a base portion for engagement with a generally planar support surface and an upstanding portion;

(b) a sleeve connected to said upstanding portion of said support frame;

(c) an arm assembly rotatably connected to said sleeve for rotation relative thereto from a first upright position to an intermediate position, to a downward position, said arm assembly including a hub portion telescopically received within said sleeve and an arm portion having an axial center line, said arm portion being connected to and extending from said hub portion in a manner such that said axial center line extends at an acute angle with respect to a plane spaced apart from and generally parallel to said planar support surface;

(d) an elongated connector cable carried by said arm assembly for movement with respect thereto, said elongated connector cable having first and second ends;

(e) gripping means connected to said first end of said elongated connector cable for gripping by the trainee;

(f) resistance means connected to said second end of said elongated connector cable for yieldably resisting movement of said connector cable relative to said arm assembly.

2. The exercise apparatus as defined in claim 1, further including locking means carried by said tubular sleeve and operably associated with said arm assembly for locking said arm assembly in a selected position.

3. The exercise apparatus as defined in claim 1 in which said resistance means comprises a plurality of stretchable members.

4. The exercise apparatus as defined in claim 1 in which said resistance means comprises free weights.

5. The exercise apparatus as defined in claim 1 in which said resistance means comprises a selectorized weight stack.

6. The exercise apparatus as defined in claim 1 in which said base portion is disposed within a first plane and in which said sleeve has a central axis extending at an acute angle with respect to a second plane spaced-apart from and generally parallel to said first plane.

7. The exercise apparatus as defined in claim 6 in which said acute angle is between about 12 and about 18 degrees.

8. The exercise apparatus as defined in claim 6 in which said upstanding portion of said support frame is disposed in a third plane generally perpendicular to said first plane and in which, upon rotation of said arm assembly into said intermediate position, said central axis of said sleeve extends at an acute angle relative to said third plane.

9. The exercise apparatus as defined in claim 8 in which said resistance means further comprises interconnection means for selectively interconnecting said stretchable members with said second end of said elongated connector cable.

10. The apparatus as defined in claim 8 in which each of said stretchable members includes a connector element and in which said interconnection means comprises:

(a) receiving means for receiving said connector elements of said stretchable members and a plurality of interengaging members movable relative to said receiving means between a first position and a second connector element engagement position, said receiving means comprising spaced-apart walls for supporting said interengaging members; and (b) selector means for selectively moving said interengaging members between said first and second positions.

11. The exercise apparatus as defined in claim 10 in which said interengaging members comprise rollers movable relative to said walls of said receiving means.

12. The exercise apparatus as defined in claim 11 in which said rollers include a first pair of spaced-apart, generally centrally disposed rollers; a second pair of spaced-apart rollers disposed on one side of said first pair of rollers; and a third pair of spaced-apart rollers disposed on the opposite side of said first pair of rollers.

13. An exercise apparatus for use by a trainee in the performance of exercises comprising:

(a) a supporting frame having a base portion for engagement with a generally planar support surface and an upstanding portion;

(b) a generally cylindrically shaped, tubular sleeve connected to said upstanding portion of said support frame, said tubular sleeve having an axial centerline extending at an acute angle with respect to a plane spaced-apart from and generally parallel to said planar support surface;

(c) an arm assembly rotatably connected to said sleeve for rotation relative thereto from a first upright position to an intermediate position, to a downward position, said arm assembly including a generally cylindrically shaped hub portion telescopically received within said tubular sleeve and a tubular arm portion having an axial center line, said arm portion being connected to and extending from said hub portion in a manner such that said axial center line extends at an acute angle with respect to a plane spaced apart from an generally parallel to said planar support surface;

(d) an elongated connector cable carried by said arm assembly for movement with respect thereto, said elongated connector cable having first and second ends;

(e) gripping means connected to said first end of said elongated connector cable for gripping by the trainee;

(f) resistance means connected to said second end of said elongated connector cable for yieldably resisting movement of said connector cable relative to said arm assembly, said resistance means comprising a plurality of stretchable members; and (g) locking means carried by said tubular sleeve and operably associated with said arm assembly for locking said arm assembly in a selected position.

14. The exercise apparatus as defined in claim 13 in which said obtuse angle is between about 100 and about 120 degrees.

15. The exercise apparatus as defined in claim 13 in which said acute angle is between about 12 and about 18 degrees.

16. The exercise apparatus as defined in claim 13 in which said upstanding portion of said support frame is disposed in a third plane generally perpendicular to said first plane and in which, upon rotation of said arm assembly into said intermediate position, said central axis of said sleeve extends at an acute angle relative to said third plane.

17. The exercise apparatus as defined in claim 13 in which said resistance means further comprises interconnection means for selectively interconnecting said stretchable members with said second end of said elongated connector cable.

18. The apparatus as defined in claim 17 in which each of said stretchable members includes a connector element and in which said interconnection means comprises:

(a) receiving means for receiving said connector elements of said stretchable members and a plurality of interengaging members movable relative to said receiving means between a first position and a second connector element-engagement position, said receiving means comprising spaced-apart walls for supporting said interengaging members; and (b) selector means for selectively moving said interengaging members between said first and second positions.

19. The exercise apparatus as defined in claim 18 in which said interengaging members comprise rollers movable relative to said walls of said receiving means.

20. The exercise apparatus as defined in claim 19 in which said rollers include a first pair of spaced-apart, generally centrally disposed rollers; a second pair of spaced-apart rollers disposed on one side of said first pair of rollers; and a third pair of spaced-apart rollers disposed on the opposite side of said first pair of rollers.

21. The exercise apparatus as defined in claim 20 in which, upon rotation of said arm assembly into said intermediate position, said central axis of said sleeve extends at an acute angle relative to said third plane of between about 60 and about 80 degrees.

22. An exercise apparatus for use by a trainee in the performance of exercises comprising:

(a) a supporting frame having a base portion for engagement with a generally planar support surface and an upstanding portion;

(b) a generally cylindrically shaped, tubular sleeve connected to said upstanding portion of said support frame;

(c) an elongated connector cable carried by said generally cylindrically shaped, tubular sleeve for movement with respect thereto, said elongated connector cable having first and second ends;

(d) gripping means connected to said first end of said elongated connector cable for gripping by the trainee; and (e) resistance means for yieldably resisting movement of said connector cable relative to said tubular sleeve, said resistance means comprising operably associated upper and lower assemblages connected to said supporting frame, each said upper and lower assemblage comprising a plurality of stretchable members, said second end of said elongated connector cable being connected to said upper assemblage.

* * * * *